US008056753B2

(12) United States Patent
Koefelda et al.

(10) Patent No.: US 8,056,753 B2
(45) **Date of Patent: *Nov. 15, 2011**

(54) BOTTLE CRATE

(75) Inventors: Gerald R. Koefelda, Rowlett, TX (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/724,493

(22) Filed: Mar. 16, 2010

(65) Prior Publication Data

US 2010/0170823 A1 Jul. 8, 2010

Related U.S. Application Data

(63) Continuation of application No. 12/021,804, filed on Jan. 29, 2008, now Pat. No. 7,694,839, which is a continuation of application No. 10/979,675, filed on Nov. 1, 2004, now Pat. No. 7,322,486, which is a continuation of application No. 09/626,517, filed on Jul. 27, 2000, now Pat. No. 6,899,247.

(51) Int. Cl.
*B65D 1/34* (2006.01)
*B65D 21/02* (2006.01)
*B65D 85/00* (2006.01)

(52) U.S. Cl. ..... 220/516; 206/519

(58) Field of Classification Search ..... 220/509, 220/513–519, DIG. 2; 206/203, 427, 503, 206/505, 515, 518, 519
See application file for complete search history.

(56) References Cited

U.S. PATENT DOCUMENTS

| | | | |
|---|---|---|---|
| 4,899,874 | A | 2/1990 | Apps et al. |
| 4,978,002 | A | 12/1990 | Apps et al. |
| 5,031,761 | A | 7/1991 | de Larosiere |
| D319,129 | S | 8/1991 | Apps et al. |
| 5,060,819 | A | 10/1991 | Apps |
| D327,357 | S | 6/1992 | Rehrig |
| D327,972 | S | 7/1992 | Apps et al. |
| D354,167 | S | 1/1995 | Stahl |
| D356,211 | S | 3/1995 | Apps et al. |
| D360,758 | S | 8/1995 | Umiker |
| D361,431 | S | 8/1995 | Koefelda |

(Continued)

FOREIGN PATENT DOCUMENTS

WO 94/10053 5/1994

OTHER PUBLICATIONS

Photographs of Rehrig Pacific Company's 1/2-depth Crate, Model No. 16/20oz-24-38 HDT, Approx. 1995, 1 page.

(Continued)

*Primary Examiner* — Harry Grosso
(74) *Attorney, Agent, or Firm* — Carlson, Gaskey & Olds

(57) ABSTRACT

A nestable crate for bottles which includes a floor member and first and second pairs of opposed sidewalls integrally formed with the floor member. Each sidewall includes a side band member which is defined by a centrally disposed upper edge and lower edge. The lower edge is spaced above the floor member by a predetermined distance to define a sidewall nesting area therebelow. The upper and lower edges each contoured downwardly to form a corner band portion having a corner upper edge and corner lower edge, wherein each nesting area matingly receives a corresponding side band member of a crate nested subjacent thereto.

44 Claims, 21 Drawing Sheets

U.S. PATENT DOCUMENTS

| | | | |
|---|---|---|---|
| D361,663 | S | 8/1995 | Kalin |
| 5,465,843 | A | 11/1995 | Koefelda |
| 5,501,352 | A | 3/1996 | Apps |
| 5,529,176 | A | 6/1996 | Apps et al. |
| D378,249 | S | 3/1997 | Apps et al. |
| D379,121 | S | 5/1997 | Apps et al. |
| D379,717 | S | 6/1997 | Apps et al. |
| D380,613 | S | 7/1997 | Apps et al. |
| D380,901 | S | 7/1997 | Apps et al. |
| 5,651,461 | A | 7/1997 | Apps et al. |
| 5,660,279 | A | 8/1997 | Apps et al. |
| 5,704,482 | A | 1/1998 | Apps et al. |
| D399,060 | S | 10/1998 | Apps et al. |
| D399,061 | S | 10/1998 | Apps et al. |
| D400,012 | S | 10/1998 | Apps |
| 5,823,376 | A | 10/1998 | McGrath |
| D401,066 | S | 11/1998 | Ackermann |
| 5,842,572 | A | 12/1998 | Apps et al. |
| D404,204 | S | 1/1999 | Apps |
| 5,855,277 | A | 1/1999 | Apps et al. |
| D410,778 | S | 6/1999 | Apps et al. |
| D412,399 | S | 8/1999 | Apps et al. |
| 5,979,654 | A | 11/1999 | Apps |
| 6,006,912 | A | 12/1999 | McGrath |
| D420,220 | S | 2/2000 | Apps et al. |
| D421,183 | S | 2/2000 | Koskinen |
| D423,217 | S | 4/2000 | Varfeldt |
| 6,047,844 | A | 4/2000 | McGrath |
| D424,299 | S | 5/2000 | Varfeldt |
| 6,073,793 | A | 6/2000 | Apps et al. |
| 6,237,758 | B1 | 5/2001 | Hsu |
| D446,015 | S | 8/2001 | Apps |
| 6,749,065 | B1 | 6/2004 | Hammett |
| 6,899,247 | B1 | 5/2005 | Koefelda et al. |
| 6,966,442 | B2 | 11/2005 | Hassell et al. |
| 7,694,839 | B2 * | 4/2010 | Koefelda et al. ..... 220/516 |

OTHER PUBLICATIONS

Photographs of Rehrig Pacific Company's 20oz. 1/2-depth Solid Wall Crate, Approx. Jun. 1999, 1 page.

Photographs of Scepter Inc.'s 20oz. Crate, Approx. Jul. 1997, 1 page.

Photographs of P&E Inc.'s Crate, Model No. BV-20/24-IN-24, Approx. Apr. 1998, 1 page.

Photographs of P&E Inc.'s 20oz. Crate, Approx. Jun. 1999, 1 page.

Photographs of Norseman Plastics Inc.'s 20oz. Crate, Approx. Jun. 2000, 1 page (not admitted to be prior art).

Photographs of Rehrig Pacific Company's 16/20oz. Splash Crate, Approx. Mar. 1998, 2 pages.

Arbitration Brief of Norseman Plastics Limited on Invalidity of U.S. Patent Nos. 6,899,247 and 6,966,442, Nov. 12, 2008.

Norseman's Reply Brief Regarding Invalidity, Jan. 12, 2009.

Declaration of Roger Nolan in Support of Norseman's Contention that U.S. Patent Nos. 6,996,442 and 6,899,247 are Invalid, Nov. 12, 2009.

Rehrig's Arbitration Brief, Group B—Validity, (Nov. 2008).

Rehrig's Reply Brief, Group B—Validity, (2008).

Declaration and Expert Report of William Patrick Apps, Dec. 22, 2008.

Invalidity Claim Chart for U.S. Patent Nos. 6,966,442 and 6,899,247, (2008).

Partial Award of Arbitrators, Mar. 12, 2009.

* cited by examiner

BOTTLE CRATE

CROSS-REFERENCE TO RELATED APPLICATIONS

This is a continuation of U.S. Ser. No. 12/021,804, filed on Jan. 29, 2008 now U.S. Pat. No. 7,694,839, which is a continuation of U.S. Ser. No. 10/979,675, filed on Nov. 1, 2004, now U.S. Pat. No. 7,322,486, which is a continuation application of U.S. Ser. No. 09/626,517, filed on Jul. 27, 2000, now U.S. Pat. No. 6,899,247.

TECHNICAL FIELD

This invention relates to a bottle crate.

BACKGROUND ART

Generally, beverage bottles go through a bottle facility and are loaded into trays which are then palletized. A pallet may include multiple layers of trays of a single product, such as soft drinks or beer of the same brand. Trays in successive layers are stacked or cross-stacked on top of each other, with the bottles bearing most of the load of the above-stacked trays. These bulk pallets are then typically stored in a warehouse for shipping to retailers.

One recent advance in the distribution area is a use of a product handling device known as the Tygard Claw® manufactured by Tygard Machine and Manufacturing Company of Pittsburgh, Pa. The Tygard Claw can be installed to the front or the side of a conventional fork lift carriage, and enables a distributor to pick from a bulk pallet of product one layer at a time. Briefly, the Tygard Claw is a large clamping device with four individual walls that approach a layer of product on a pallet squarely and uniformly by each wall moving toward and away from a pallet layer in a translating motion. The actuators for the walls are equipped so that the walls are touch sensitive in order to lift the product without damage. These clamping devices such as the Tygard Claw enables distributors to assemble shipments of product without the need to manually pick and move layers of product.

In many cases depending on the particular crate and its contents, the crate may be deformed to point where the beverage containers loaded in the crate contact each other. Crates under these conditions may eventually fail due to the repeated stress, deflection, and deformation.

Consequently, there is a need for an improved bottle crate which is able to withstand the automated handling devices described above. The improved crate should be able to withstand the repeated stress to which it is subjected by such automated handling devices. The improved crate should also have relatively less deflection and deformation and improved durability than present crates in order to enhance and lengthen the life of the crate.

DISCLOSURE OF INVENTION

It is an object according to the present invention to provide an improved crate for bottles which is able to work efficiently with automated handling devices.

It is another object according to the present invention to provide an improved crate for bottles which is more durable and subject to less deflection and deformation.

It is another object according to the present invention to provide an improved crate for bottles having corner areas which are adapted to better withstand the stresses placed on such crates.

It is still another object according to the present invention to provide an improved bottle crate which is stackable and nestable with similar crates.

In accordance with these objects and goals, provided is a nestable crate for bottles which includes a floor member and first and second pairs of opposed sidewalls integrally formed with the floor member. Each sidewall includes a side band member which is defined by a centrally disposed upper edge and lower edge. The lower edge is spaced above the floor member by a predetermined distance to define a sidewall nesting area therebelow. The upper and lower edges are each contoured downwardly—which in one embodiment is preferably in the plane of its respective sidewall—to form a corner band portion having a corner upper edge and corner lower edge, wherein each nesting area matingly receives a corresponding side band member of a crate nested subjacent thereto.

In one embodiment, the sidewall includes a plurality of projection members which extend upwardly above the upper edges of each band member and received within corresponding openings formed in the lower edge when nested below a similar crate. The crate according to the present invention may also include a corner projection member which extends upwardly from the upper surface of the corner wall portion and received within a corresponding corner opening formed in the corner lower edge when nested below a similar crate. The upper surface of the sidewall and corner wall projections are substantially co-planar.

In one embodiment, one of the first and second pairs of opposed sidewalls includes an opening for providing visibility into the crate and the other pair of sidewalls includes a handle member for handling the crate. The sidewalls have a double-wall construction. Preferably, the sidewalls have an outer portion defined by the band member, and an inner surface which is integrally attached to the floor member.

In keeping with the present invention, also provided is a nestable crate for bottles which includes a base and a sidewall structure which extends upwardly from the base and is attached thereto. The sidewall structure includes a continuous band member which has a pair of opposed side band portions, a pair of opposed end band portions, and corner band portions disposed between each adjacent side band portion and end band portion. The band member includes a contoured upper edge and lower edge, wherein the lower edge at the side band portions and end band portions is spaced above the base a predetermined distance to define a corresponding nesting area therebelow which receives the corresponding side band portion and end band portion when nested with a similar crate. The upper edge at the side band portions and end band portions are directed downwardly such that the upper edge at the corner band portion is disposed below the plane of the upper edge at the side band portions and end band portions to define a corner pocket disposed above the corner portion upper edge.

The above objects and other objects, features, and advantages of the present invention are readily apparent from the following detailed description of the best modes for carrying out the invention when taken in connection with the accompanying drawings.

BEST MODE FOR CARRYING OUT THE INVENTION

Figure 1:
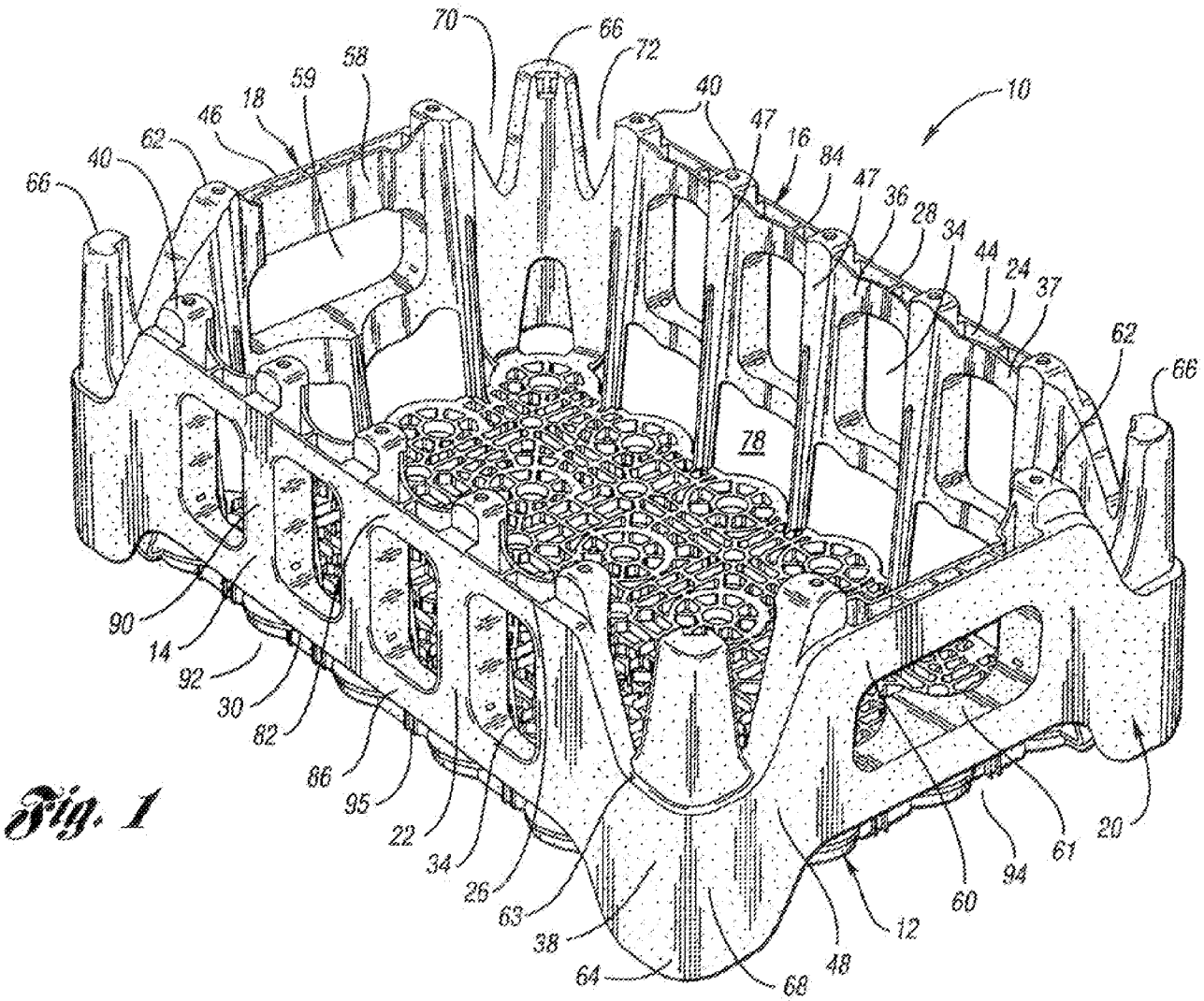
FIG. 1 is a perspective view of a first embodiment of the bottle crate according to the present invention.
Figure 2:
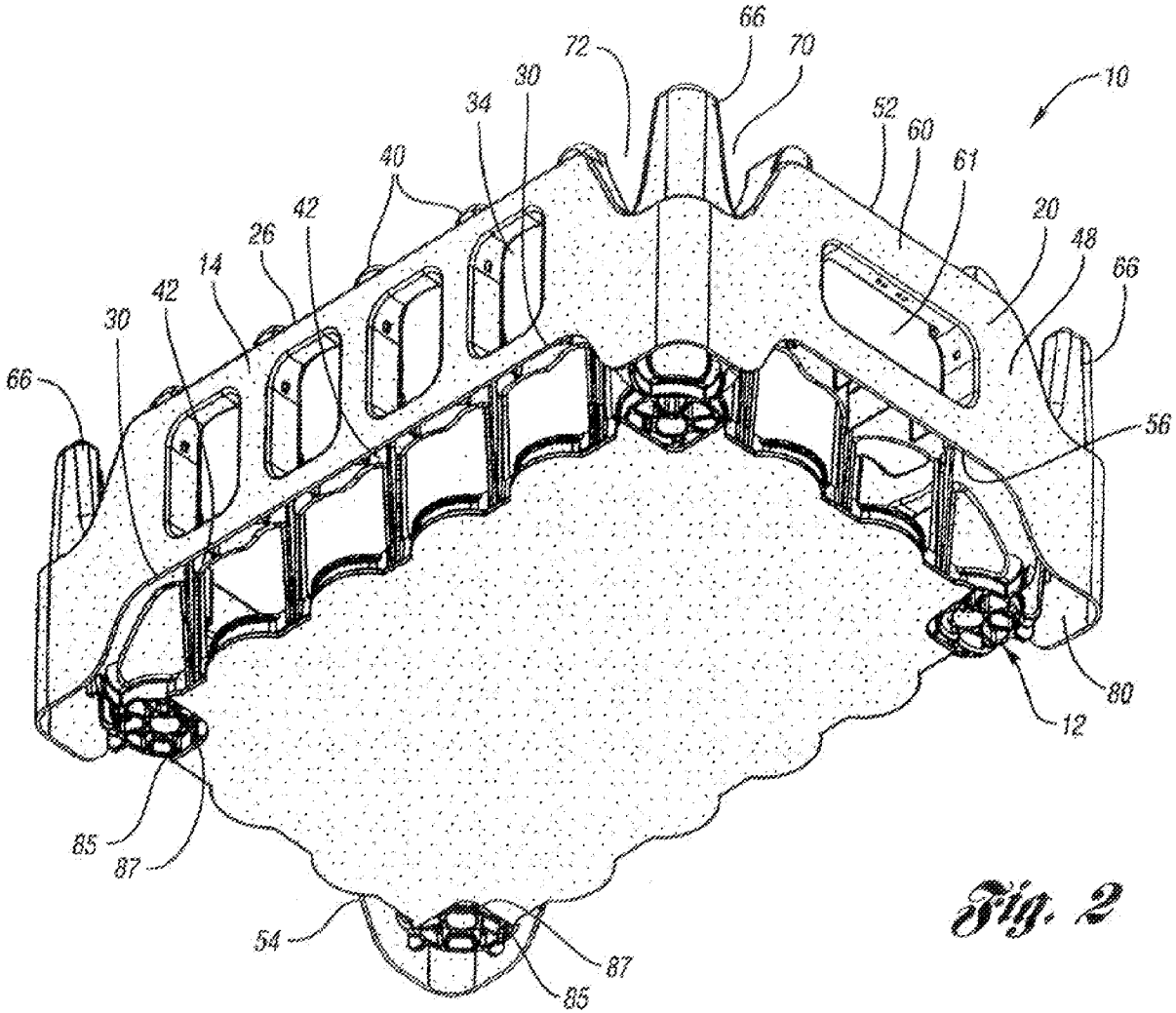
FIG. 2 is a bottom perspective view of the bottle crate of FIG. 1, wherein the pattern of the floor member is only partially shown, and is more particularly shown in FIG. 4.
Figure 3:
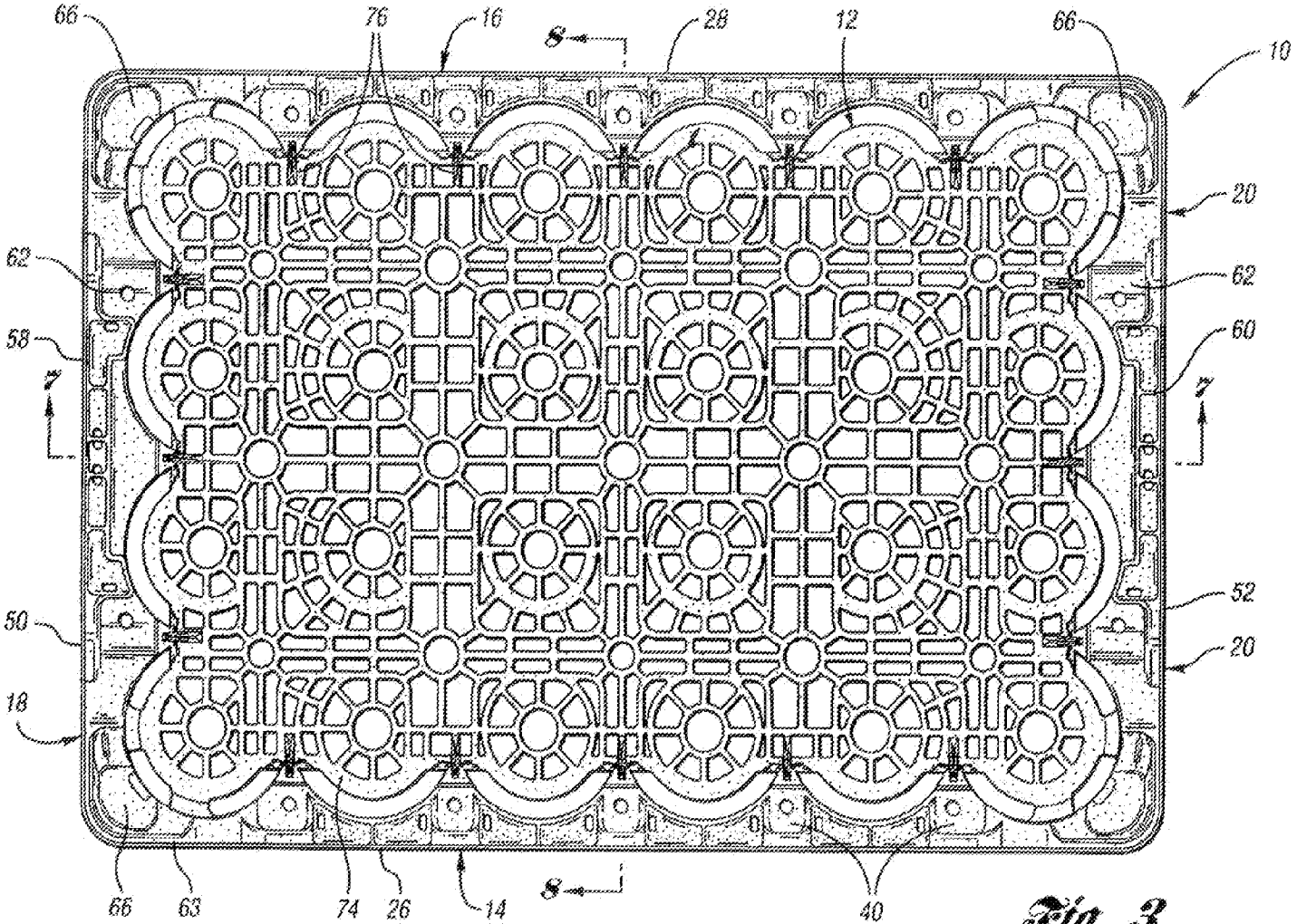
FIG. 3 is a top plan view of the bottle crate.

With references to FIGS. 1-8 of the drawings, illustrated is a first embodiment of a bottle crate 10 according to the present invention. Crate 10 may also be referred to as a tray, container or case, and is formed of a plastic material and preferably a thermoplastic material. Crate 10 includes a floor member or base 12, a first pair of opposed sidewalls 14, 16 and a second pair of opposed sidewalls 18, 20. For ease of reference, the second pair of opposed sidewalls 18, 20 is referred to herein as a pair of end walls 18, 20. Sidewalls 14, 16, end walls 18, 20 and floor member 12 are integrally formed with each other in order to define a compartment therein. As best illustrated in FIGS. 1 and 3, floor member 12 is inwardly offset from the planes of each sidewall 14, 16 and end wall 18, 20.

Sidewalls 14, 16 include a band member 22, 24 defined by an upper edge 26, 28 and a lower edge 30, 32. In a preferred embodiment, sidewalls 14, 16 include one or more openings or windows 34 corresponding to each bottle disposed along the inner surface 36 of sidewalls 14, 16. Openings 34 provide a view into the crate and are preferably at label height so that the label of the bottles contained within crate 10 are visible. Lower edges 30, 32 are raised and offset from the plane of floor member 12 at a central region of band members 22, 24 and are contoured downwardly toward each corner portion 38. In the embodiment shown in FIGS. 1-13, the contour of the band upper and lower edges appears undulating.

As illustrated in FIGS. 1 and 5-8, sidewalls 14, 16 also include a plurality of raised projections 40 extending above the plane of upper sidewall edges 26, 28 for assisting with nesting of similar crates 10, as illustrated and disclosed in FIGS. 9-13 herein, and the associated text.

As shown in FIGS. 1-3, sidewalls 14, 16 and end walls 18, 20 are illustrated as having a double wall thickness. As illustrated in FIGS. 2, 4, 10, 11, lower edges 30,32 of sidewalls 14,16 include recesses 42 between the double structure for receiving the projections 40 of a similar crate nested there below, thereby helping to secure the crates when in a nesting orientation. These openings 42, openings 44 on upper edge 24,28,50,52 and windows 34 also assist in reducing material and thus providing a lower weight crate.

End walls 18, 20 also include an end wall band member 46, 48, each having an upper edge 50, 52 and a lower edge 54, 56. End walls 18, 20 have formed therein a handle member 58, 60 which provides a means to handle the container in association with handle openings 59, 61, which also provide a similar function to window openings 34 in that the handle openings 59, 61 allow the crate contents and bottle labels proximate thereto to be visible. As with the sidewalls 14,16, the end wall band members 46,48—and more particularly upper edges 50,52 and lower edges 54,56—are raised in a central portion and are contoured downward in the end wall plane toward corner portions 38 to define corner band 64. Lower edges 54, 56 are raised upward from floor member 12. End walls 18, 20 also include upwardly raised projections 62, similar to sidewall projections 40, which serve to assist with nesting. Projections 40, 62, generally also help to distribute load across the crate.

Figure 4:
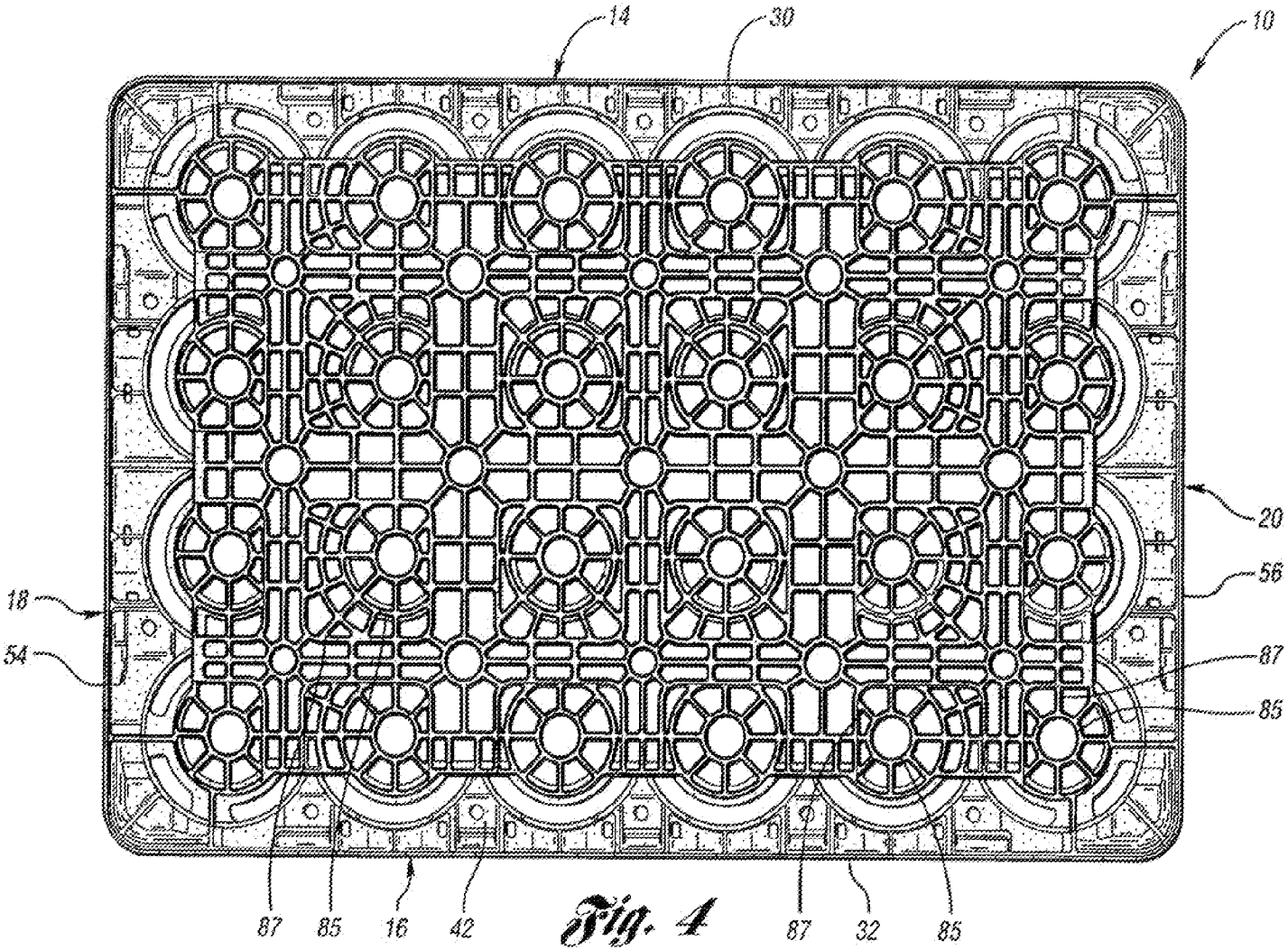
FIG. 4 is a bottom plan view of the bottle crate.
Figure 5:
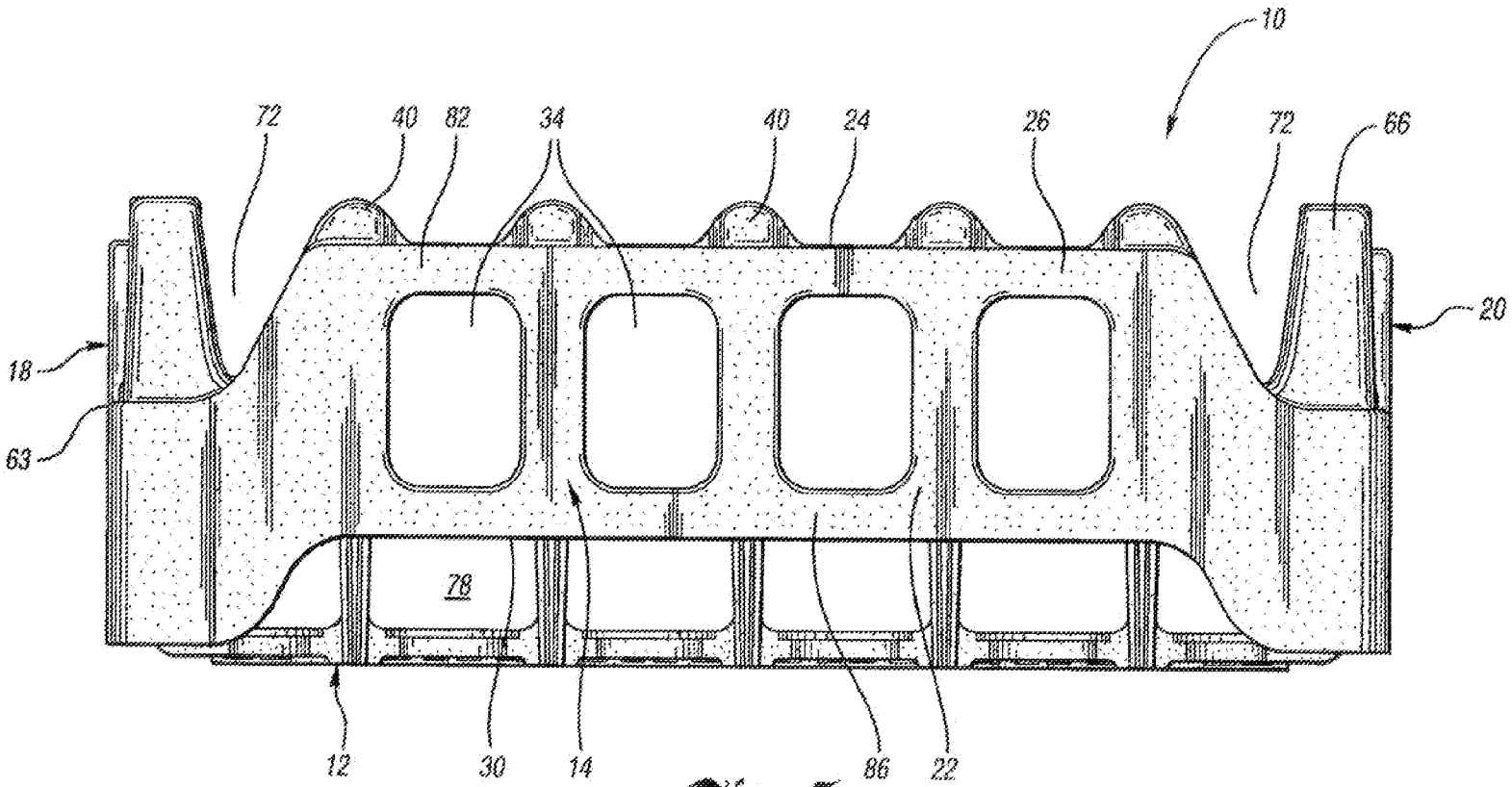
FIG. 5 is a front elevational view of the bottle crate, the rear elevational view being a mirror image thereof.
Figure 6:
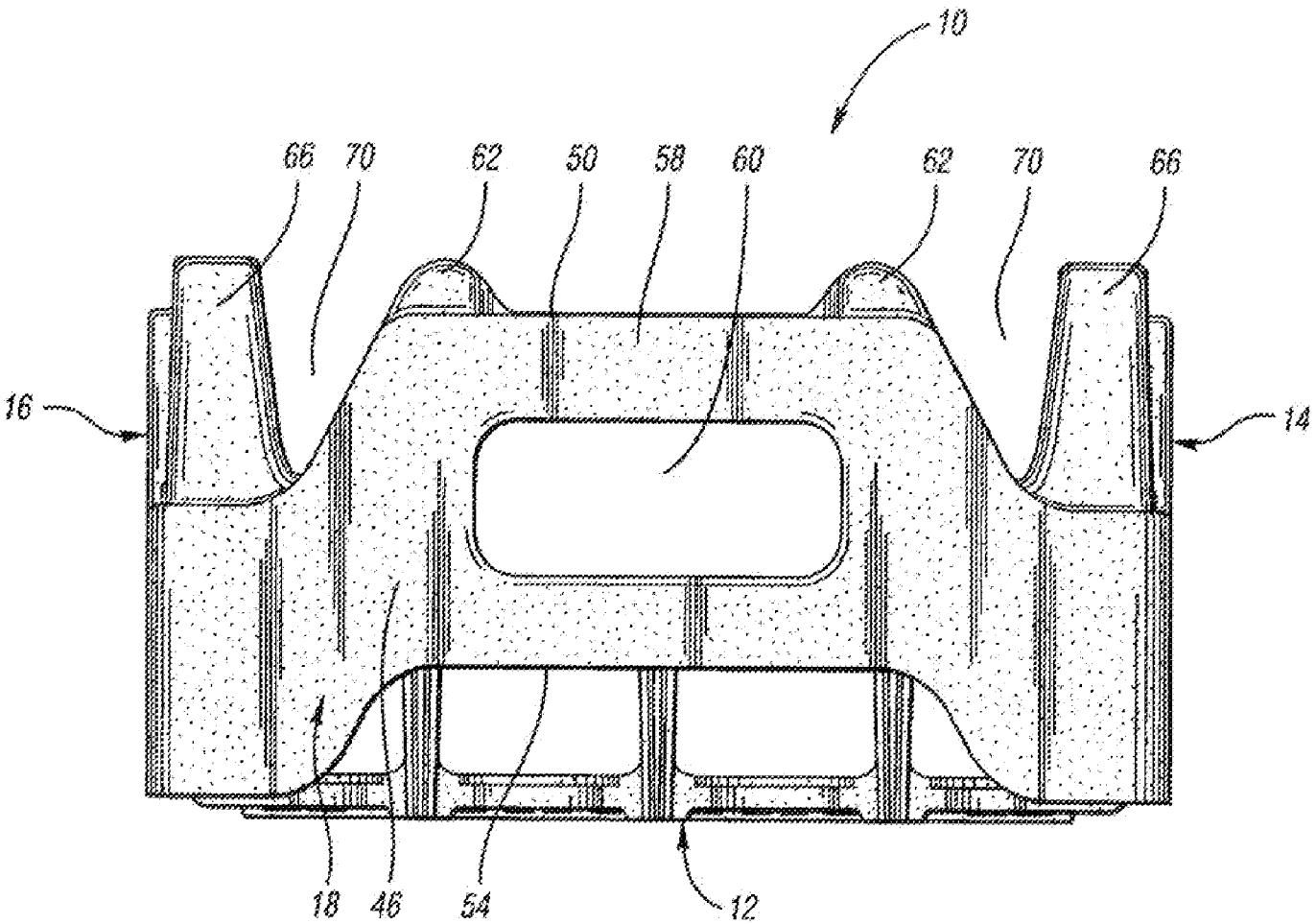
FIG. 6 is a left hand elevational view of the bottle crate, the right hand view being a mirror image thereof.
Figure 7:
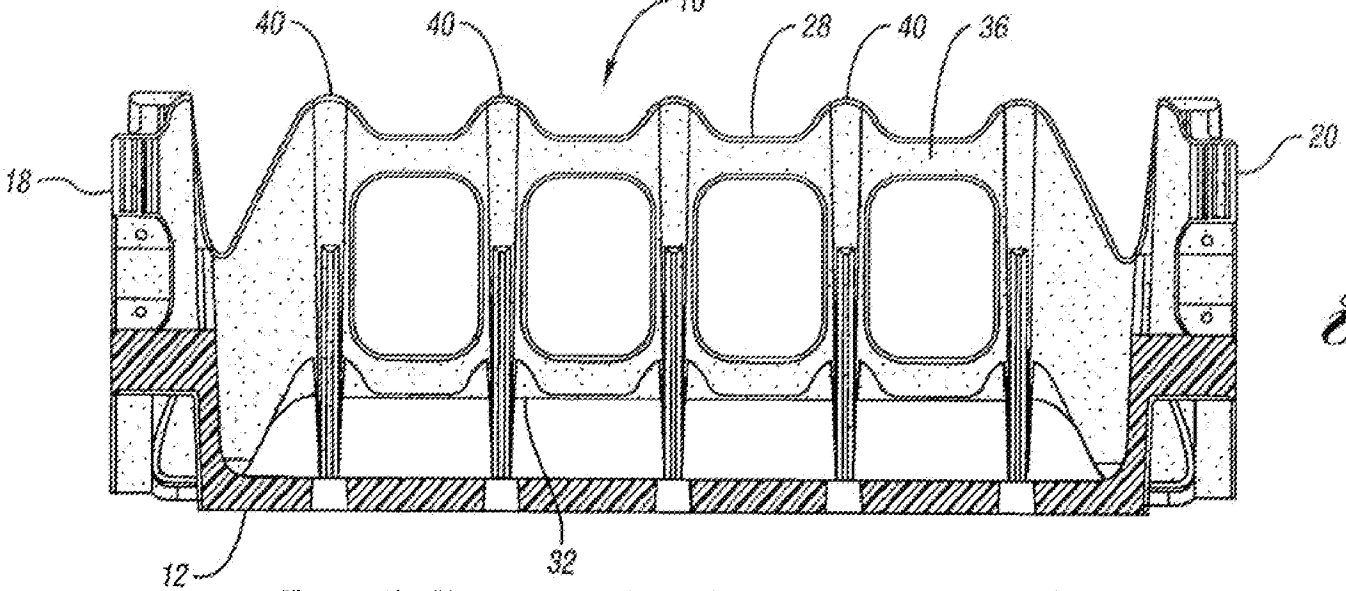
FIG. 7 is cross-sectional view along line 7-7 of FIG. 3, the longitudinal centerline.
Figure 8:
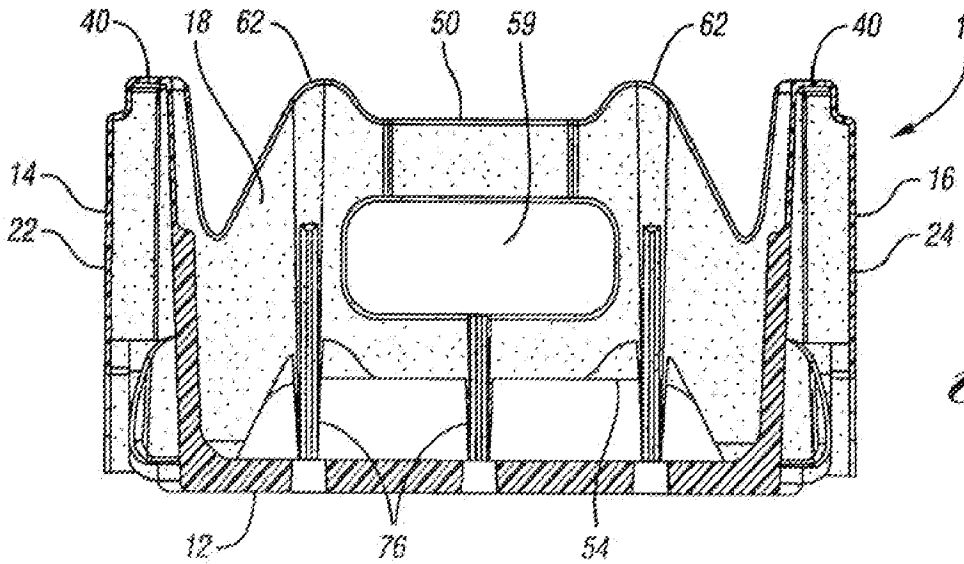
FIG. 8 is a cross-sectional view along line 8-8 of FIG. 3, the transverse centerline.
Figure 9:
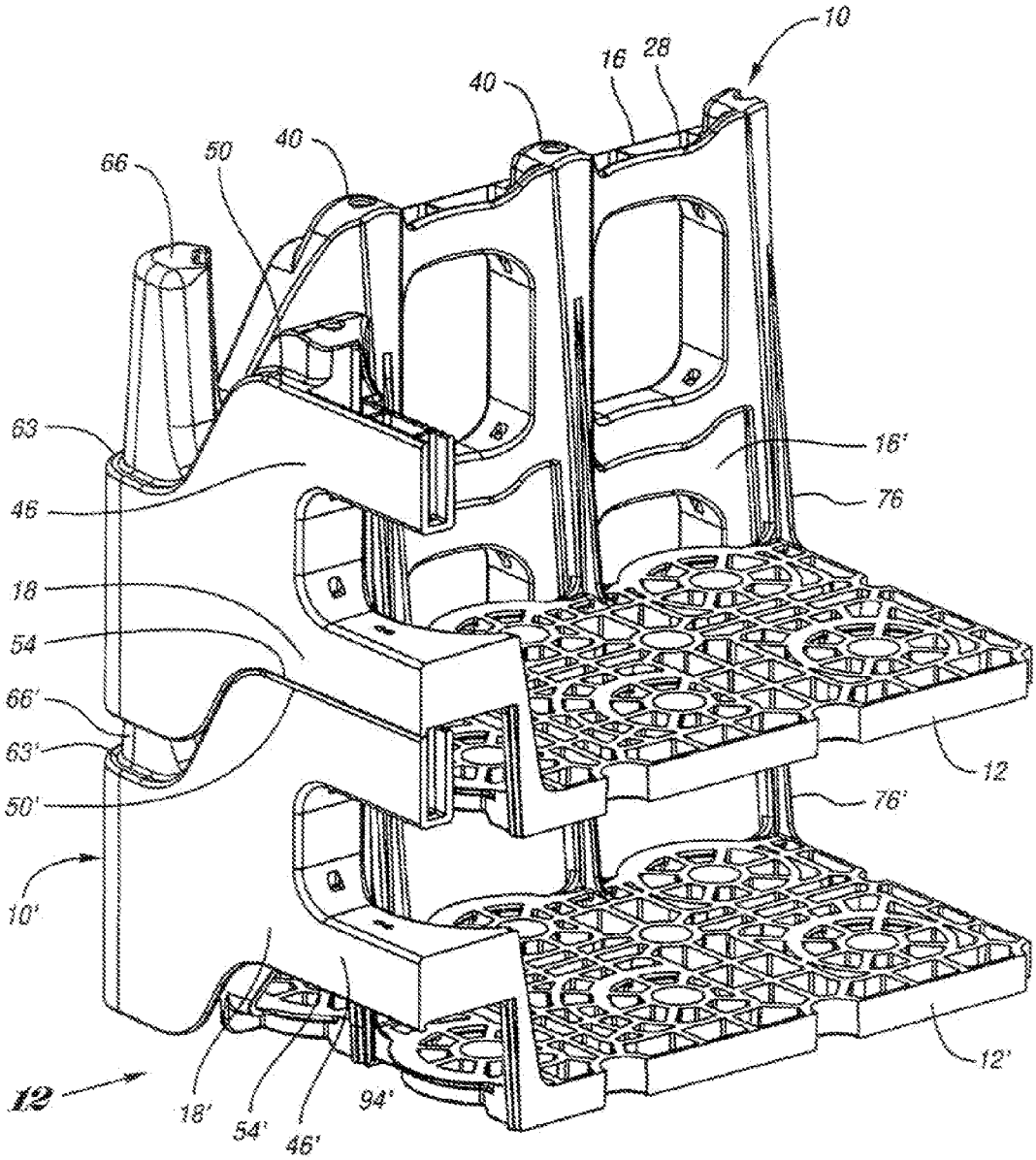
FIG. 9 is a partial cross-sectional perspective view showing two similar crates according to the present invention in a nested orientation.

Attention is directed to corner portions 38. As illustrated, corner portions 38 include a lower corner band 64 defined by the contoured outboard edges of the sidewall band members 22,24 and end walls band members 46,48 adjacent to each corner portion 38. Corner portions 38 also include an upstanding corner projection portion 66 which extends above the upper surface 63 of corner band member 64 and as illustrated in FIGS. 1 and 5-6, is slightly offset inwardly from outer surface 68 of band member 64. The upper surface of corner projection 66 is substantially co-planer with the upper surface of sidewall projections 40 and end wall projections 62. Note that like projections 40 and 62, when nested, corner projections 66 are received within corner openings 80 shown in FIGS. 2 and 4. In addition to nesting, projection members 40, 62, and 66 also serve to transfer load from one crate 10 to another.

Each corner projection 66 has on either side an opening or pocket 70, 72 disposed between projection 66 and the adjacent sidewall band members 22, 24 and end wall band members 46, 48, such that while the band portions 22, 24, 46, 48 and 64 are continuous around a periphery of the crate, corner projections 66 are not directly attached to the adjacent sidewalls 14, 16 and end walls 18, 20. Accordingly, when crate 10 is used in connection with an automated handling device such as the Tygard Claw, the corner structure allows crate 10 to flex inward and does not subject the corner portions 38 to significant stresses as with previous designs. By having a free standing corner projection 66 which is not connected to the upper part of the adjoining sidewalls and end walls, sidewalls 14,16 and end walls 18,20 deflect towards the interior of the crate without putting undue stress on the corner.

With reference to the first embodiment shown in FIGS. 1-13 and more particularly to FIGS. 1 and 5-6, sidewall band members 22, 24 and end wall band members 46, 48 may also be characterized as having an upper band portion 82, 84 and a lower band portion 86, 88, which are separated by window openings 34, and are connected to each other by band columns 90.

Floor member 12 has an upper surface which includes a plurality of bottle support areas 74. In the embodiment shown, there are twenty-four bottle acceptance areas. As illustrated in FIGS. 2 and 4, the bottom surface of floor member 12 has a plurality of recessed areas 85, defined by downwardly extending rib members 87. The recessed areas 85 correspond to bottle support areas 74 such that when a crate 10 is stacked upon a similar crate 10 positioned therein, the cap or top of each bottle portion is disposed within the recessed area to control the movement and stability of the crates when stacked. Note that floor member 12 includes an open lattice pattern in order to reduce the weight of crate 10.

Inner surfaces 36 of the sidewalls 14,16 and end walls 18,20 preferably have alternating portions 37 having a curvature in order to mate with the contour of the bottle disposed therein, but of course may also be planar without departing from the teachings according to the present invention. Between curved portions 37, the sidewalls and end walls include an inner surface portion 47. Inner surface portions 47 each include an elongated inwardly projected tab member 76 which projects inwardly into the compartment of crate 10 to provide strength to sidewalls 14, 16 and end walls 18, 20. Further, the opening 78 below the sidewall lower edges 30, 32 and the end wall lower edges 54, 56 and between members 76, allow the typically bulbous shaped bottom portion of a bottle to project slightly through opening 78 thereby allowing the inner compartment to more efficiently hold bottles therein. Also, in such a nesting orientation, the inwardly projecting portions 76 mate with and are received in corresponding outer recesses of lower wall portions 95.

FIGS. 9-13 illustrate crate 10 being nested with a similar crate 10' oriented therebelow. Those features of crate 10', corresponding to features in crate 10 shall have similar reference numerals with the addition of a prime (') designation.

Figure 10:
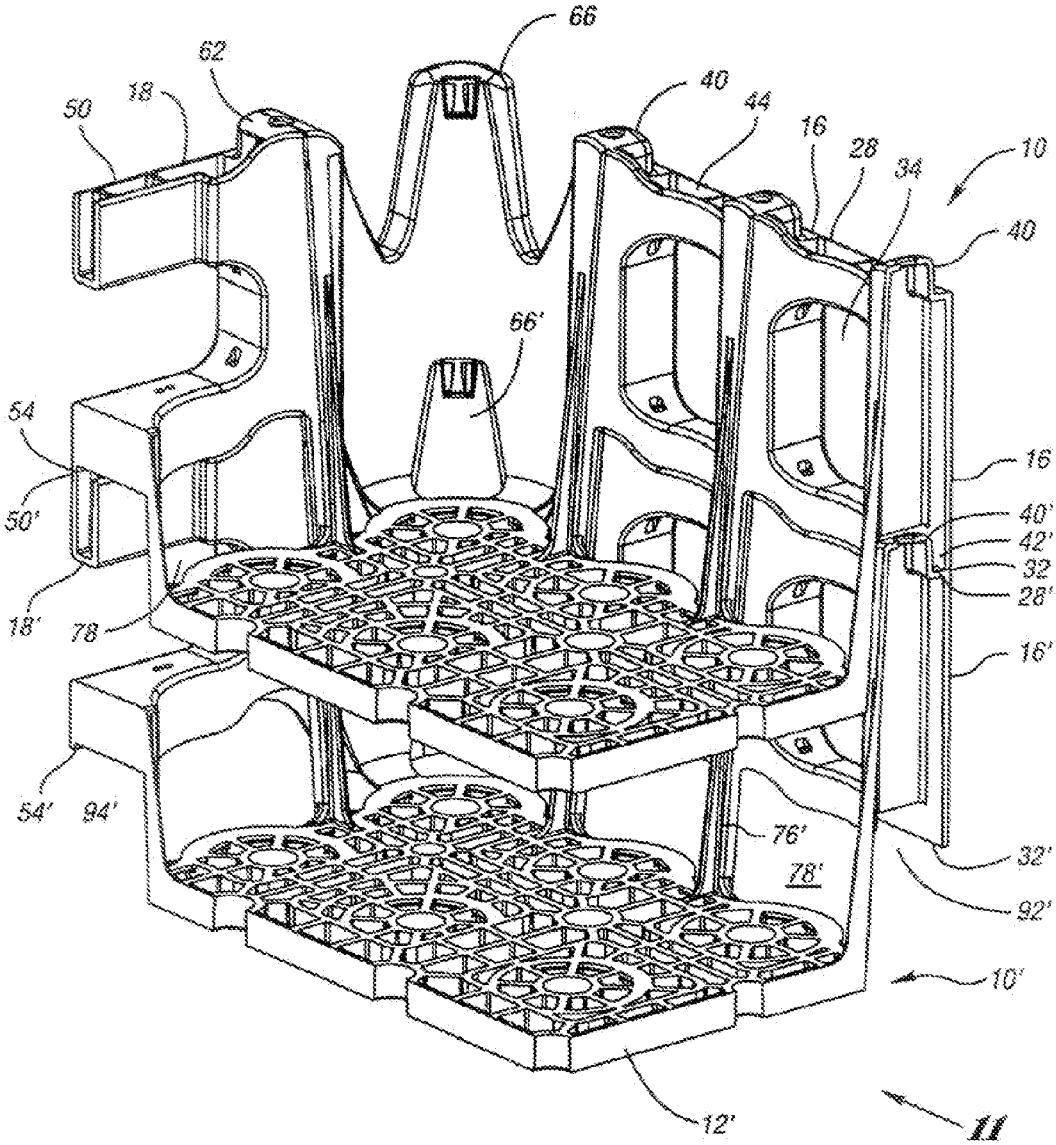
FIG. 10 is an alternate partial cross-sectional perspective view of the nested crates of FIG. 9, with focus on the interior of the crates.
Figure 11:
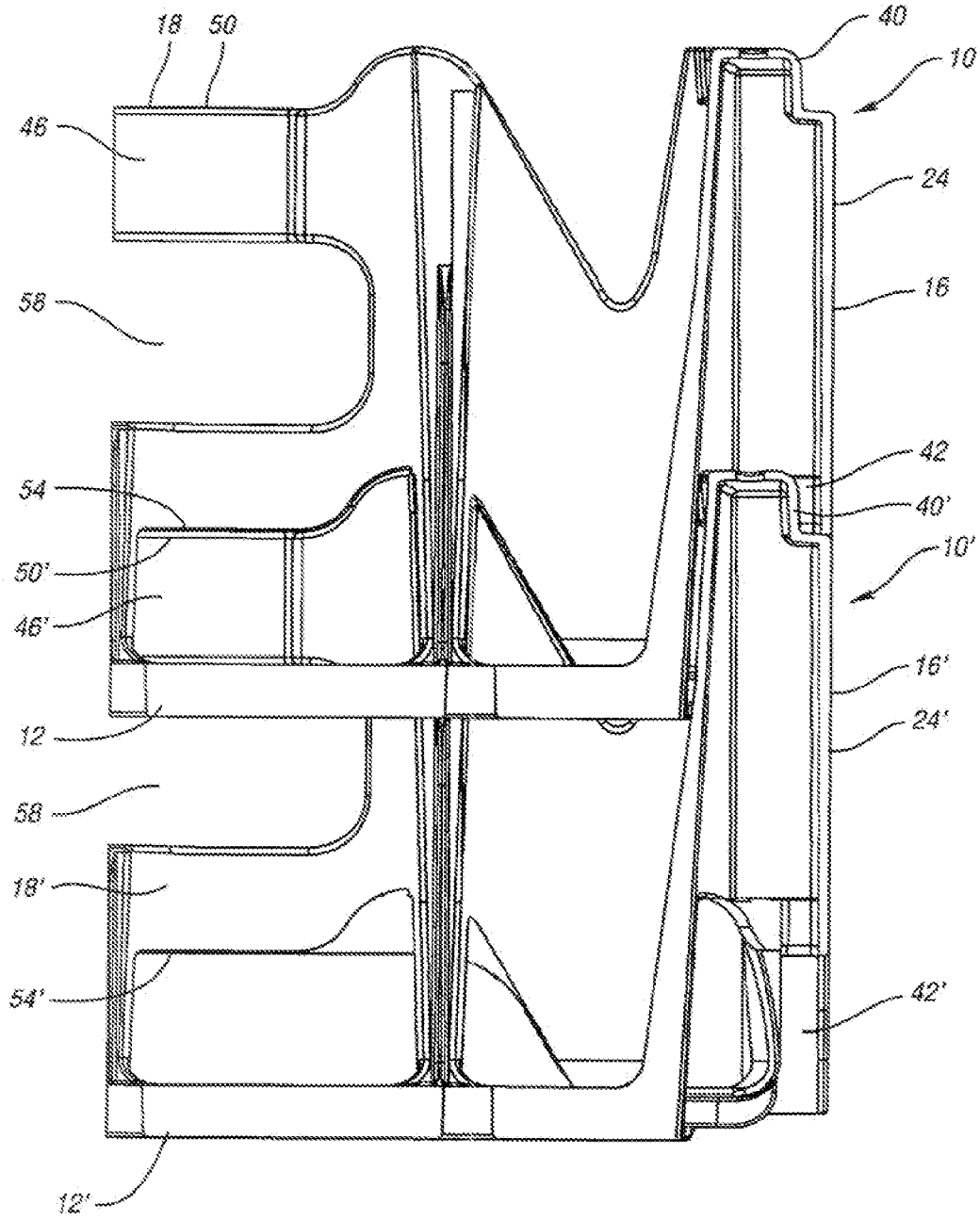
FIG. 11 is a cross-sectional side elevational view of the nested crates of FIGS. 9 and 10, taken from the view of arrow line 11 in FIG. 10.

FIGS. 10 and 11 illustrate the nest of crates 10 and 10' having a cross-section taken through sidewalls 14,16 and more particularly through a sidewall projection 40 of sidewall 16. It is illustrated therein that during nesting, sidewall projection 40' is received within lower edge openings 42, thereby allowing crates 10 and 10' to securely nest with each other. Again, the nesting feature provides for efficient storage and transport of crates 10 when not is use.

Figure 12:
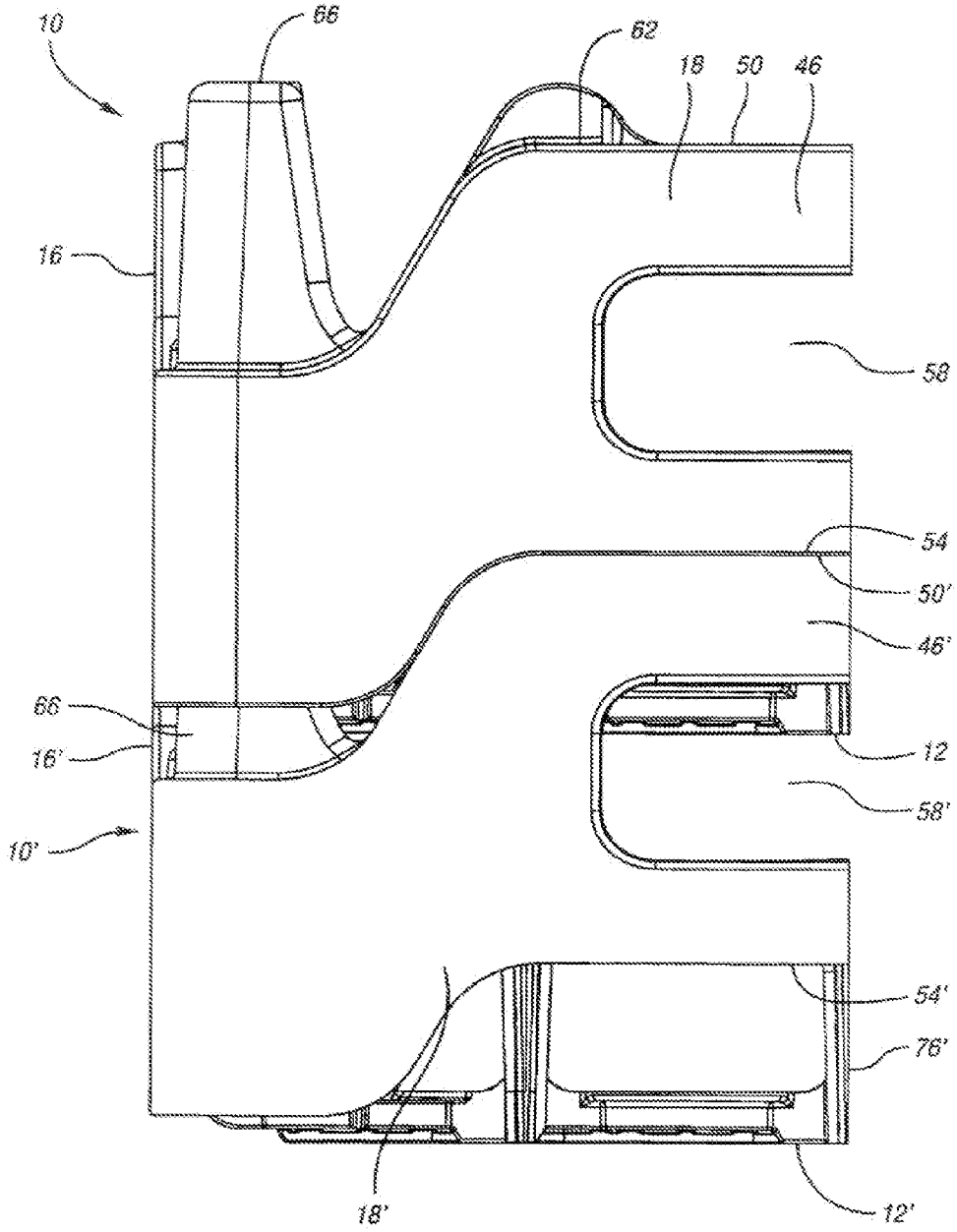
FIG. 12 is a partial side elevational view of the nested containers of FIGS. 9-11, illustrating the exterior of the nested containers taken from the view of arrow line 12 in FIG. 9.
Figure 13:
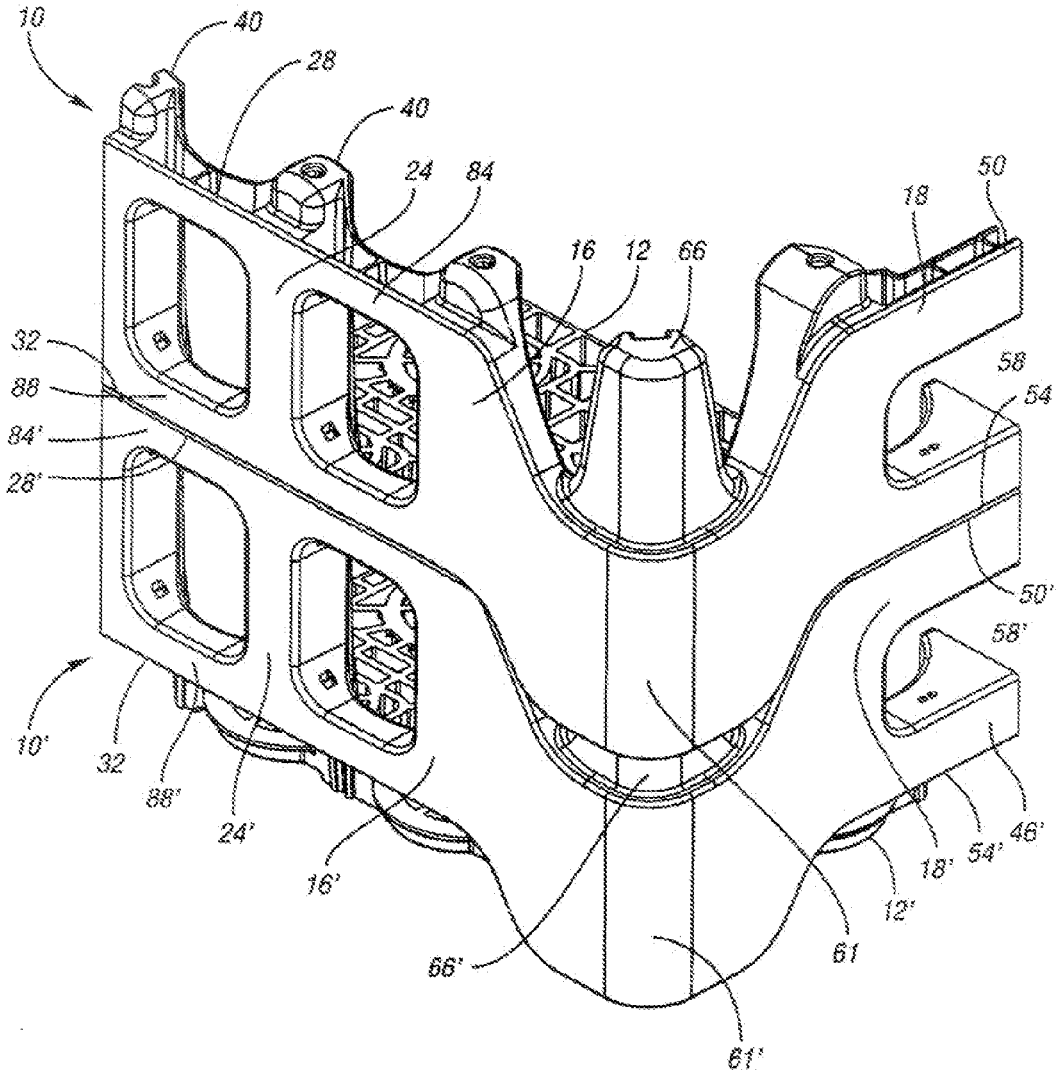
FIG. 13 is an alternate perspective view of the nested containers of FIGS. 9-12, with focus on the exterior of the corner portions of the nested crates.

With reference to FIGS. 12 and 13, illustrated therein are exterior side and perspective views of nested crates 10 and 10'. Particularly, it is noted for sidewalls 14', 16' that band members 22',24' mate with and are received within a correspondingly shaped side wall lower opening 92, below lower edges 30,32 (see also FIG. 9), while end walls band members 46',48' are received in lower end wall opening 94, beneath lower end wall edge 54,56. It is also noted from FIGS. 9, 12, and 13 that corner projection 66', like projections 40' and 62', are received within corner bottom opening 80 during the nesting orientation. Accordingly, the handles 58',60' and the sidewall upper band 82',84' provide for a stable and efficient nesting of crates 10.

Figure 14:
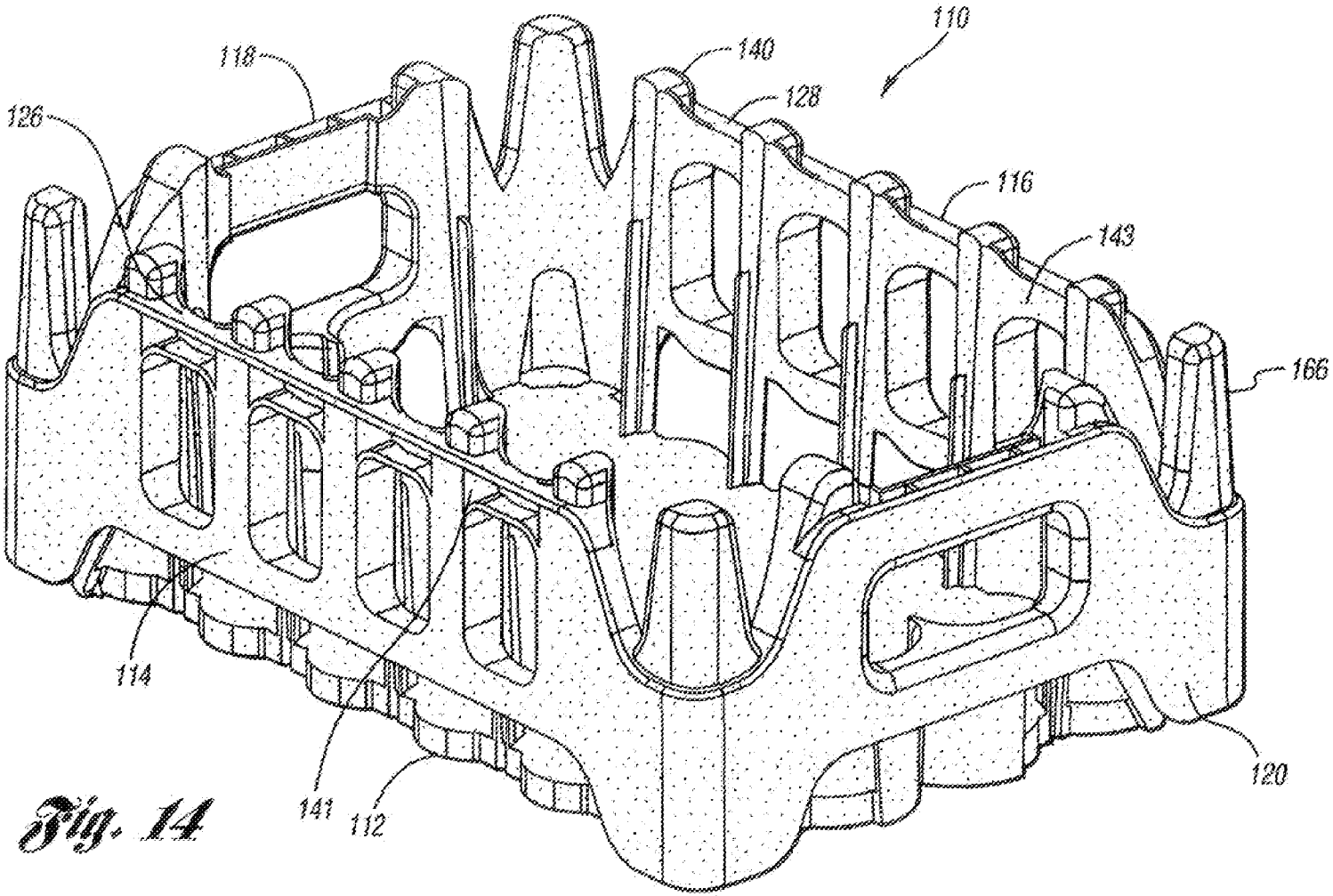
FIG. 14 is a perspective view of a second embodiment of the bottle crate according to the present invention.

FIG. 14 illustrates a second embodiment of the bottle crate, designated as bottle crate 110, according to the present invention. The features of crate 110 corresponding to those of the first embodiment shall have like reference numerals with the addition of a "1" prefix. Bottle crate 110 is generally similar to bottle crate 10, however, bottle crate 110 has a solid upper edge 126,128. While sidewalls 114,116 and end walls 118, 120 generally have a double wall thickness, directly below sidewall upper edges 126,128, the outer surface 141 is open such that the upper inner surface 143 forming the upper curved bottle support area has a single wall thickness.

With reference to FIGS. 15*a* through 19, illustrated therein is a third embodiment of a bottle crate 210 according to the present invention. The features of crate 210 corresponding to those of the first embodiment shall have like reference numerals with the addition of a "2" prefix. Accordingly, crate 210 includes a floor member 212, opposed sidewalls 214, 216, and opposed end walls 218, 220.

Sidewalls 214, 216 include a sidewall band member 222, 224, respectively, having an upper edge 226, 228 and a lower edge 230, 232. Crate 210 has a continuous band member, including corner portion 238. Instead of corner projections 66, crate 212 includes a corner opening 272 between adjacent sidewalls and end walls, displaced above corner portion 238, thus allowing crates 210 to flex when handled by automated handling equipment, as previously discussed.

The pair of opposed end walls 246, 248 has an upper edge 250, 252 and a lower edge 254, 256. Crate 210 also includes a handle portion 258, 260 integrally formed within end walls 246, 248.

Inner surface 236 of crate 10 includes curved areas 237 which mate with the bottles stored therein. Alternating between adjacent curved areas 237 are a plurality of surfaces 247 having each having an inwardly projecting member 276 for separating bottles adjacent the crate wall. It is contemplated that surfaces 247 in crate 210 are relatively wider than surfaces 47 of crate 10, because the corresponding contact area is less wide for accommodating smaller bottles, if desired. Members 276 have a rounded semi-frustoconical surface profiles. The lower portion 239 of inner surface 247 also projects inwardly such that there is a transitional portion 241 disposed between upper portion 243 and bottom portion 239. This inwardly directed lower portion assists in defining a pocket to receive the lower bulbous portion of the bottles which project through opening 278.

Figure 18:
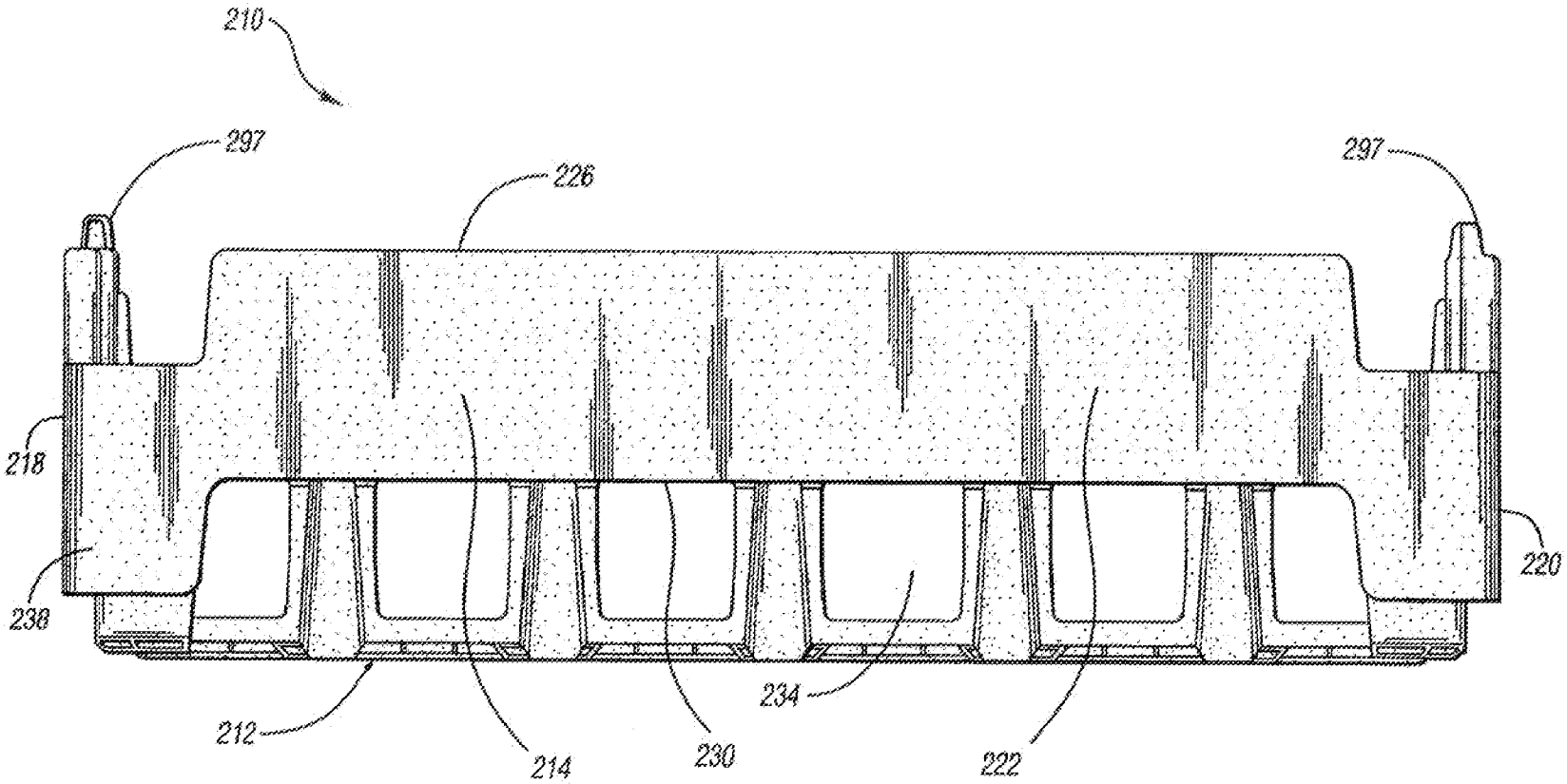
FIG. 18 is a front side elevational view of the crate of FIG. 15*a*, the rear side elevational view being substantially identical thereto.
Figure 19:
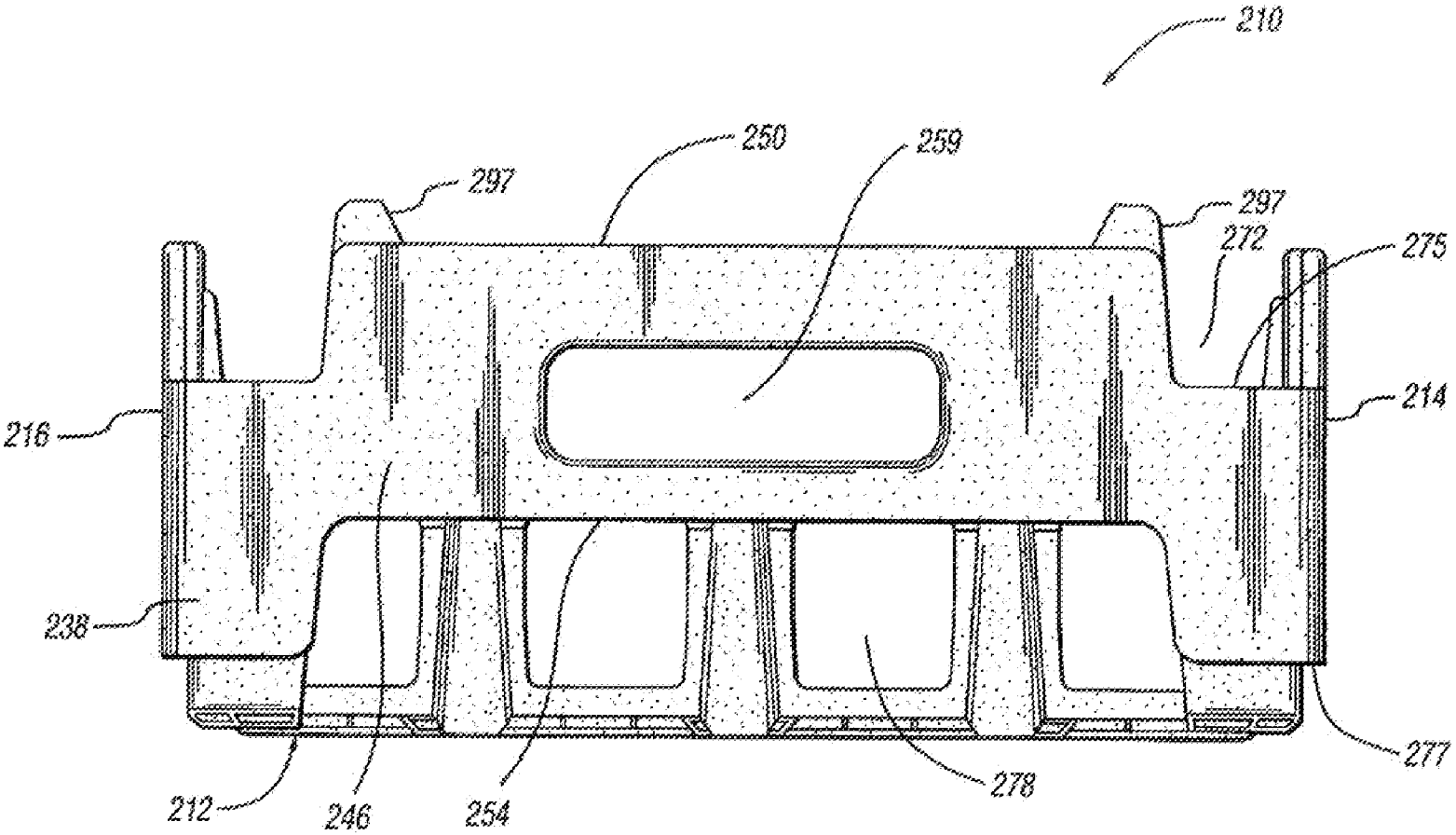
FIG. 19 is a left side elevational view of the crate of FIG. 15*a*, the right side elevational view being substantially identical thereto.

As illustrated in FIGS. 14 and 18-19, the band members 222, 224 and 246, 248 (and particularly the upper and lower edges thereof) are contoured downwardly toward corner portions 238. The contours in this embodiment may have different shapes, as those in crate 210 are less wave-like than in crate 10. Like the first embodiment of crate 10, the band members define nesting areas 292,294 therebelow, into which the sidewall and end wall band members of crates nested subjacent thereto are matingly received.

Figure 15N:
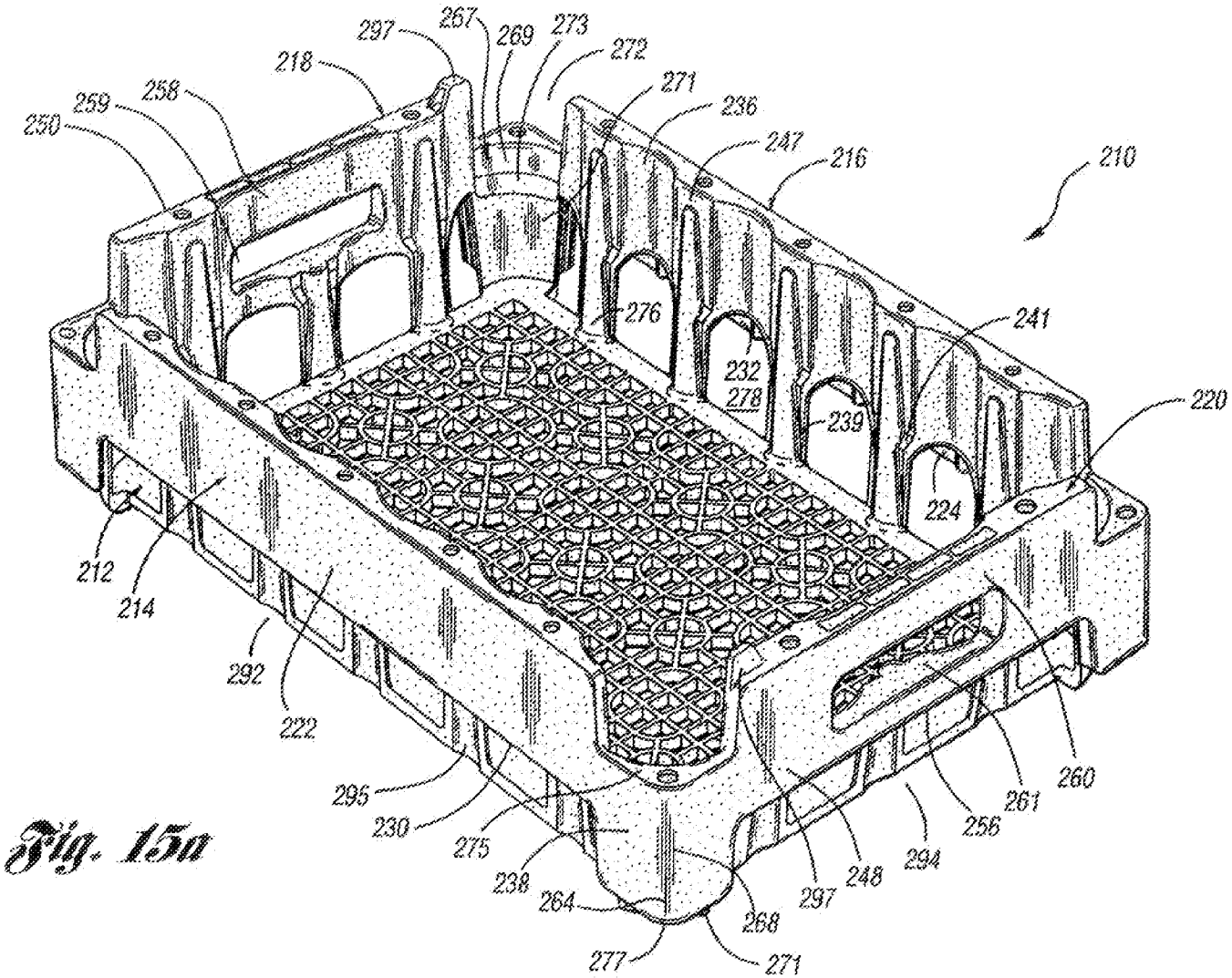
FIG. 15*a* is a full perspective view of a third embodiment of the bottle crate according to the present invention.
FIG. 15 is a partial perspective view of the third embodiment of the bottle crate shown in FIG. 15*a;*
Figure 15B:
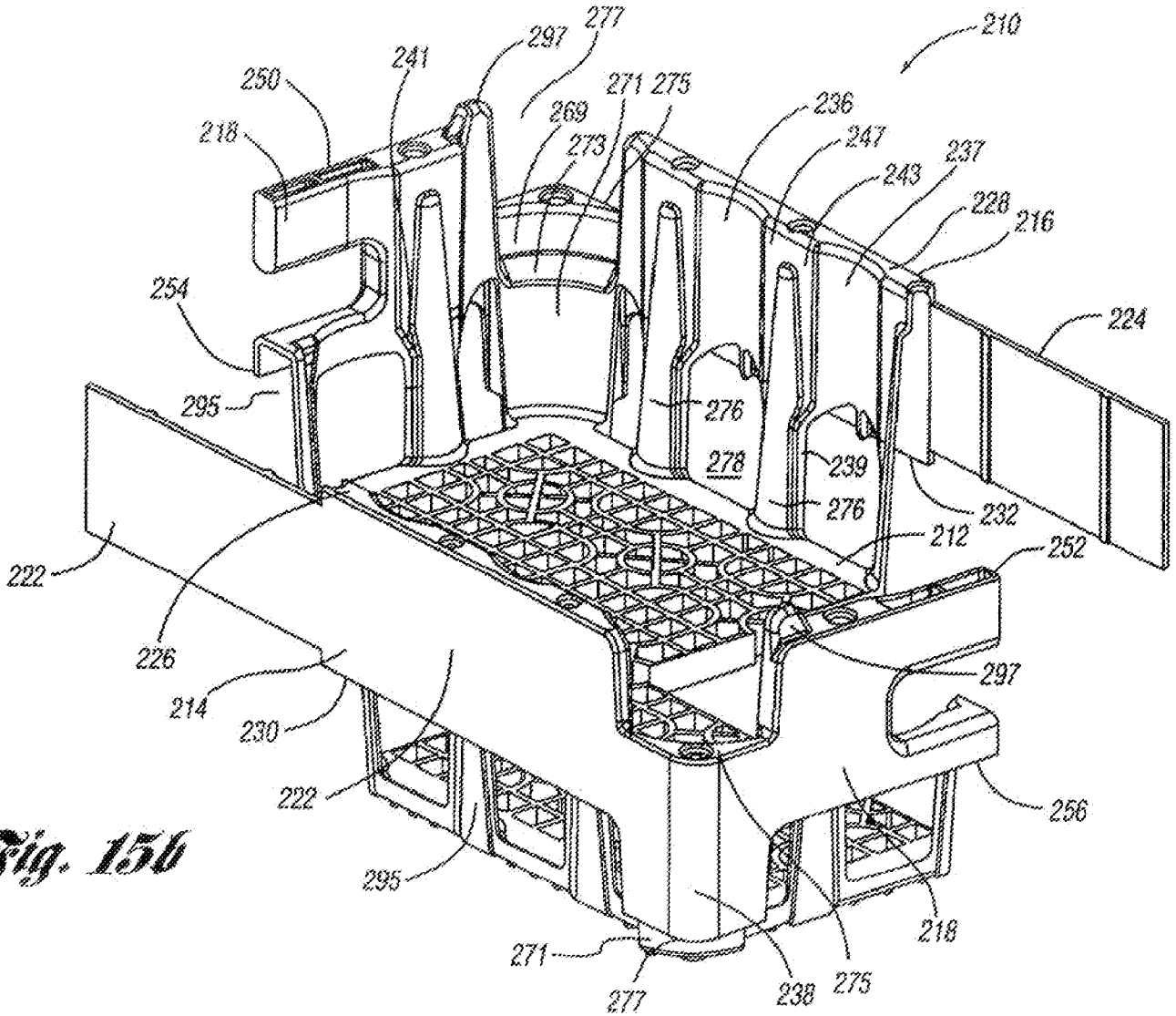
Figure 16:
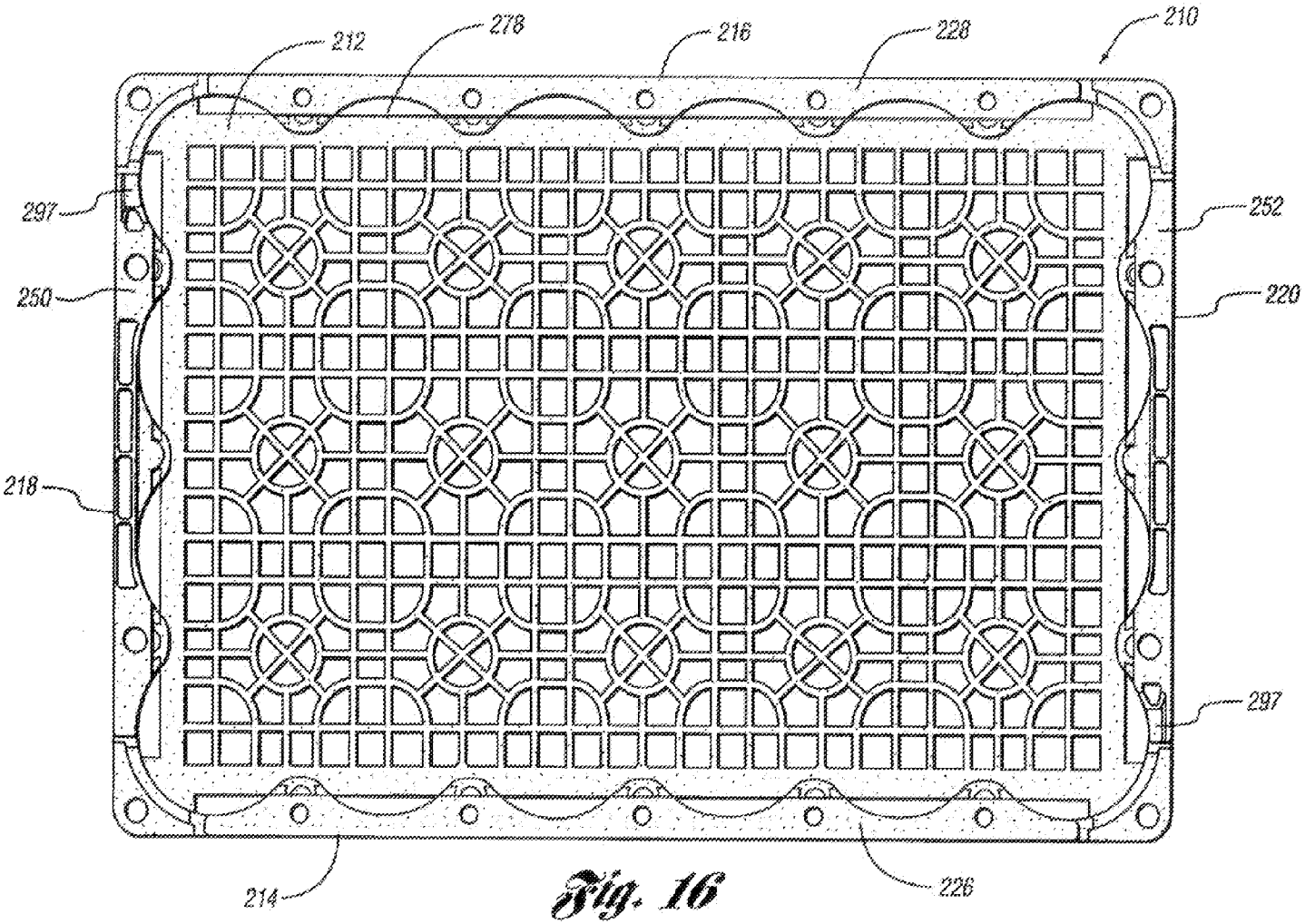
FIG. 16 is a top plan view of the crate of FIG. 15*a;*
Figure 17:
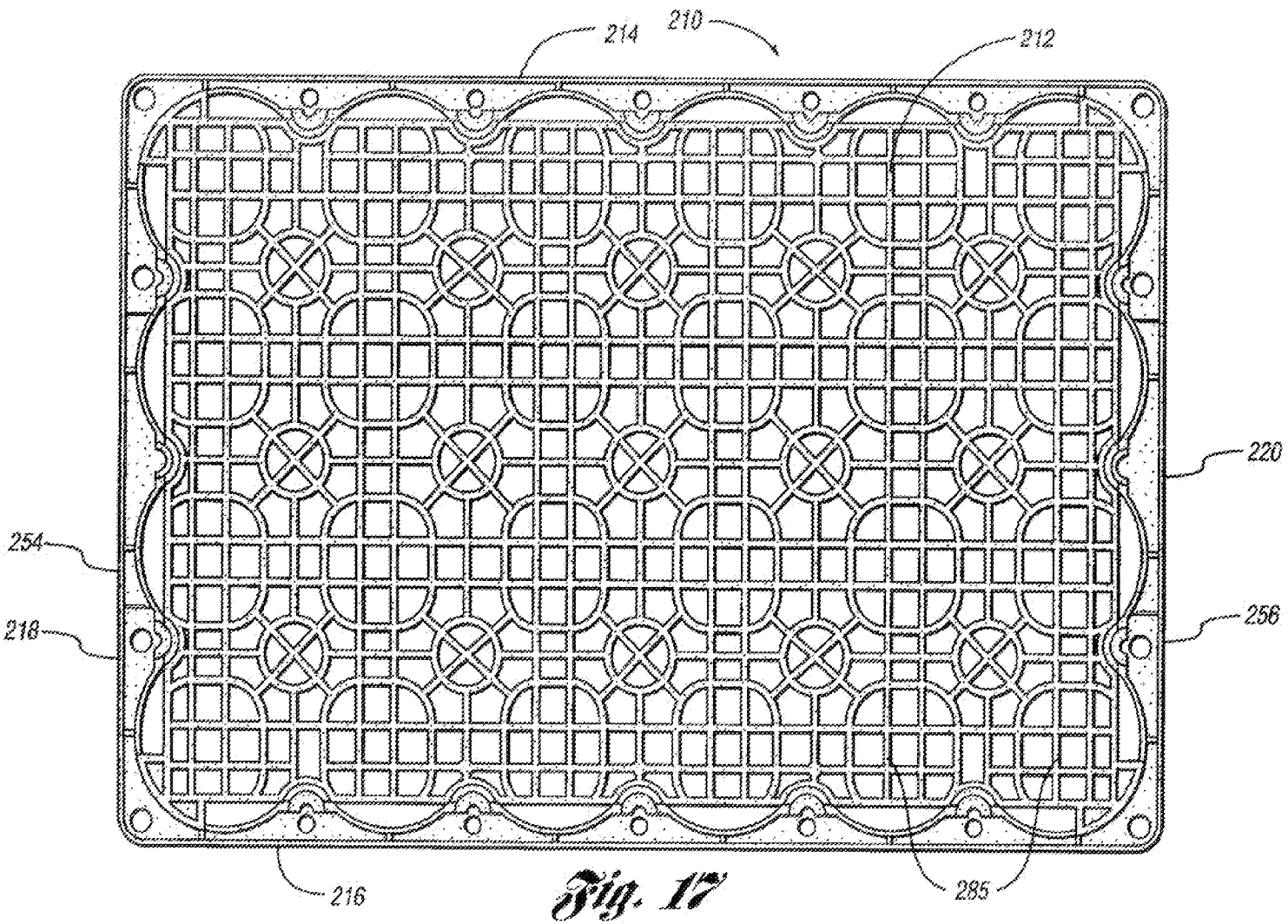
FIG. 17 is a bottom plan view of the crate of FIG. 15*a;*

Further, corner portion 238 of crate 210 includes an inner surface 267 having an outwardly offset upper portion 269, an inwardly directed lower portion 271 and a transition portion 273 therebetween. As illustrated in FIGS. 15*a* and 15*b*, the lower edge 277 of corner band 264 does not extend downward to be planar with floor member 212, such that lower corner portion 271 is visible from the crate's exterior. Thus, in a nesting orientation, lower edge 277 of corner band member 264 rests on upper surface 275 of corner band member 264. Also, in such a nesting orientation, the inwardly projecting portion 276 mate with and are received in corresponding outer recesses of lower wall portions 295.

Figure 20:
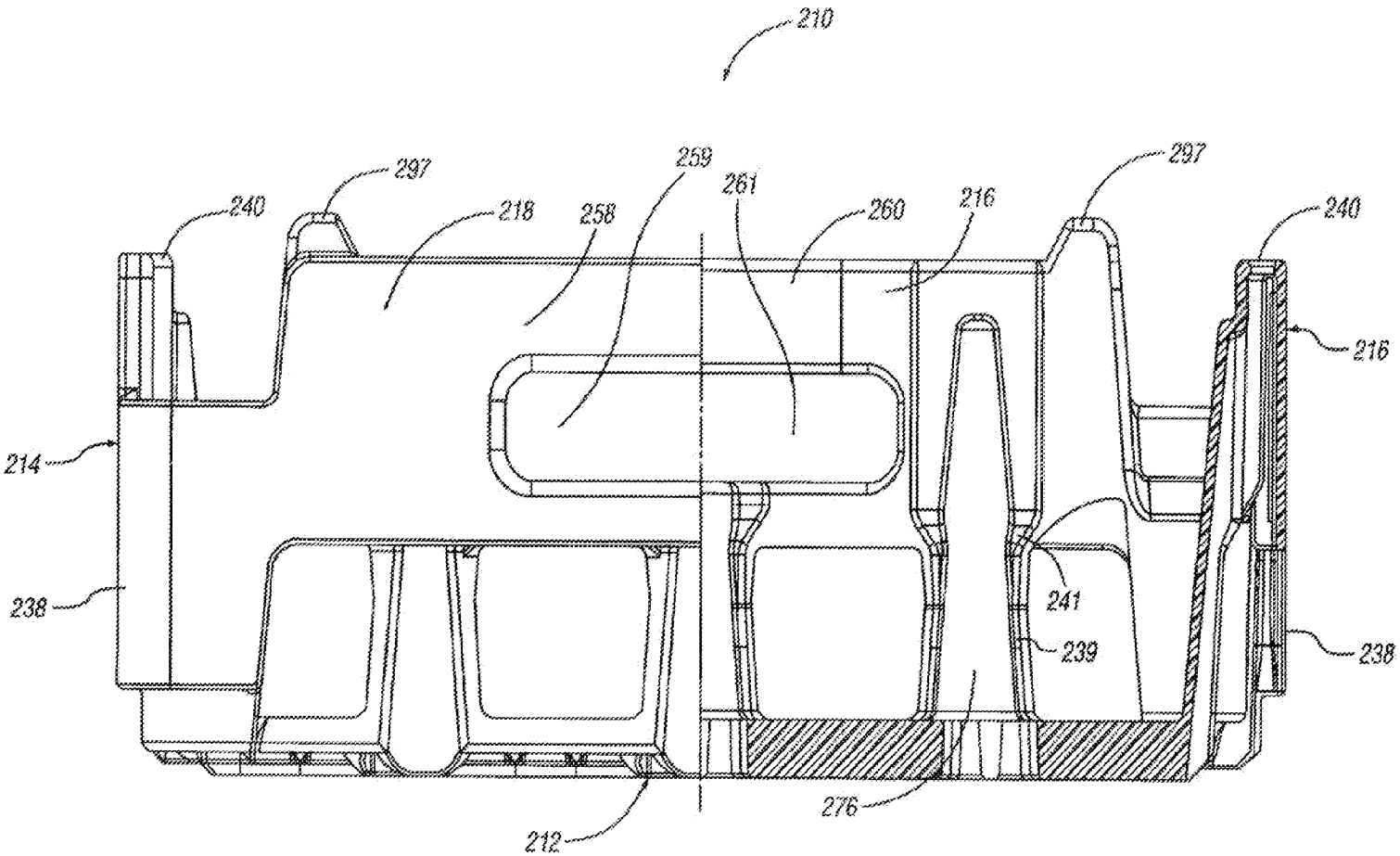
FIG. 20 is a partial end elevational, cross-sectional view (similar to FIG. 8 of the first embodiment) taken along the transverse centerline of the second embodiment of the crate of FIG. 15*a*.

Further, crate 10 includes a pair of projections 297 for hindering misuse of crate 210. Specifically, projections 297 are oriented diagonally and are disposed on opposed end walls, projecting above the band upper edges. Thus, when crate 210 is positioned upside-down on a flat surface, such that the lower surface of the floor member 212 is oriented up, projection 297 prevents crate 210 from resting in a stable manner, and thereby causes crate 210 to rock back and forth during such unintended use. When like crates are nested, projections 297 are also received within the lower edge openings of the end wall band members. FIG. 20 illustrates a partial end elevational, cross-sectional view (similar to FIG. 8 of the first embodiment) taken along the transverse centerline of the second embodiment of the crate of FIG. 15*a*.

Figure 21:
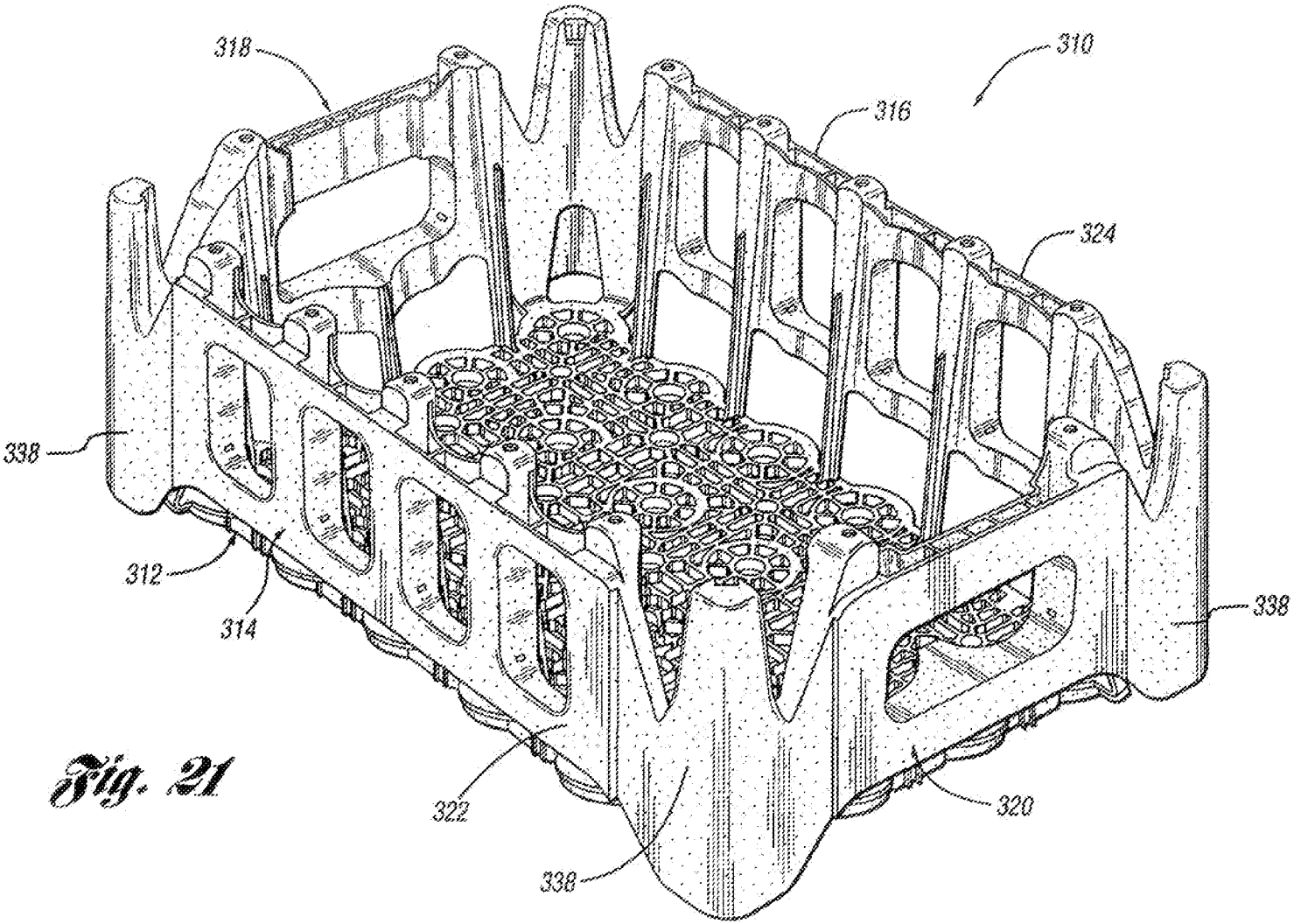
FIG. 21 is a perspective view of a third embodiment of a bottle crate according to the present invention.

With reference to FIG. 21, shown is a perspective view of a third embodiment of bottle crate 310 according to the present invention. The features of crate 310 corresponding to those of the first embodiment shall have like reference numerals with the addition of a "3" prefix. As illustrated therein, corner portions 338 are offset inwardly and recessed from the planes defined by the side wall band members 322,234 and the end wall band members 346,348. This design thereby reduces stress in corner areas 338, such that load transfer would be almost completely in the band members. The stresses to which the crate is subjected to by the aforementioned automated handling equipment would also be placed upon the band members.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A nestable display crate comprising:

a floor defining a substantially flat surface, wherein the substantially flat surface is substantially rectangular; and a wall structure including endwalls and sidewalls extending around a periphery of the floor, wherein the sidewalls include portions of different heights;

wherein the sidewalls include a lower wall portion and an upper wall portion, the lower wall portion is connected to the floor, and at least a portion of the upper wall portion has a double wall thickness including two spaced apart walls separated by a void, and wherein the endwalls include a cutout and a handle opening, wherein the cutout is located between two corner sections, the two corner sections have a first height, the endwalls have a second height, and the first height is less than the second height.

2. The crate of claim 1, wherein the lower wall portion includes an alternating arrangement of interior panels connected to the floor and a window.

3. The crate of claim 1, wherein the cutout is substantially elongated.

4. The crate of claim 1, wherein the handle opening is substantially elongated.

5. The crate of claim 1, wherein the handle opening and the cutout are separated by a section of material.

6. The crate of claim 1, wherein a portion of the lower wall portion is defined by a single wall.

7. The crate of claim 1, wherein a bottom of the cutout is open and provides complete clearance under the cutout.

8. The crate of claim 1, wherein the handle opening is located above the cutout.

9. The crate of claim 1, wherein the cutout has a third height, and the third height is less than the second height.

10. The crate of claim 1, wherein the cutout has a first, length and the handle opening has a second length, and the first length is greater than the second length.

11. The crate of claim 1, wherein the endwalls include an endwall lower wall portion defining the cutout and an endwall upper wall portion including the handle opening.

12. The crate of claim 11, wherein the cutout and the handle opening are located in a common plane.

13. The crate of claim 1, wherein no features extend upwardly from an upper surface of the floor in an area defined by the wall structure.

14. The crate of claim 1, wherein the pair of opposed end walls each include two stepped surfaces that define a handle.

15. The crate of claim 1, wherein the endwalls each include an upper portion and a lower portion, and a width of the upper portion is less than a width of the lower portion.

16. The crate of claim 1, wherein a width of the upper wall portion of each of the sidewalls is less than a width of the lower wall portion of each of the sidewalls, and the upper wall portion is uninterrupted by openings.

17. The crate of claim 1, wherein an entirety of an upper surface of the floor is flat.

18. The crate of claim 1, wherein an upper surface of the sidewalls defines a non-flat contour.

19. The crate of claim 1, wherein the corner sections wrap around to define part of the sidewalls and part of the endwalls.

20. The crate of claim 1, wherein an upper surface of a portion of the endwall above the handle is substantially flat.

21. A nestable display crate comprising:

a floor defining a substantially flat surface, wherein the substantially flat surface is substantially rectangular; and a wall structure including endwalls and sidewalls extending around a periphery of the floor, wherein the sidewalls include a lower wall portion and an upper wall portion, the lower wall portion is connected to the floor, and at least a portion of the upper wall portion has a double wall thickness including two spaced apart walls separated by a void, and wherein the endwalls include a cutout and a handle opening, wherein the cutout is located between two corner sections, the two corner sections have a first height, the endwalls have a second height, and the first height is less than the second height, wherein the cutout and the handle opening are located in a common plane, wherein the endwalls include an endwall lower wall portion defining the cutout and an endwall upper wall portion including the handle opening, and wherein the endwall lower wall portion of the endwalls includes a recessed portion recessed inwardly relatively to the common plane, an outermost surface of the endwall upper wall portions of the endwalls are separated by a first distance and an outermost surface of the recessed portion of the endwalls lower wall portions of the endwalls are separated by a second distance, and the first distance is greater than the second distance.

22. A nestable display crate comprising:

a floor defining a substantially flat surface, wherein the substantially flat surface is substantially rectangular; and a wall structure including endwalls and sidewalls extending around a periphery of the floor, wherein the sidewalls include a lower wall portion and an upper wall portion, the lower wall portion is connected to the floor, and at least a portion of the upper wall portion has a double wall thickness including two spaced apart walls separated by a void, and wherein the endwalls include a cutout and a handle opening, wherein the cutout is located between two corner sections, the two corner sections have a first height, the endwalls have a second height, and the first height is less than the second height, wherein the cutout and the handle opening are located in a common plane wherein the endwalls include an endwall lower wall portion defining the cutout and an endwall upper wall portion including the handle opening, and wherein an outermost surface of the upper wall portions of the sidewalls define a plane, the lower wall portions of the sidewalls includes a recessed portion recessed inwardly relatively to the common plane, an outermost surface of the upper wall portions of the sidewalls are separated by a first distance, an outermost surface of the lower wall portions of the sidewalls are separated by a second distance, and the first distance is greater than the second distance.

23. A nestable display crate comprising:

a floor defining a substantially flat surface, wherein the floor is defined by a single flat area; and a wall structure including endwalls and sidewalls extending around a periphery of the floor, wherein the sidewalls include portions of different heights;

wherein the sidewalls include a lower wall portion and an upper wall portion, the lower wall portion is connected to the floor, and at least a portion of the upper wall portion has a double wall thickness including two spaced apart walls separated by a void, and wherein the endwalls include a cutout and a handle opening located above the cutout, a bottom of the cutout is open and provides complete clearance under the cutout, wherein the cutout is located between two corner sections, the two corner sections have a first height, the endwalls have a second height, and the first height is less than the second height.

24. The crate of claim 23, wherein a portion of the lower wall portion is defined by a single wall.

25. The crate of claim 3, wherein the cutout has a third height, and the third height is less than the first height.

26. The crate of claim 23, wherein the endwalls include an endwall lower wall portion defining the cutout and an endwall upper wall portion including the handle opening, and the cutout and the handle opening are located in a common plane.

27. The crate of claim 23, wherein no features extend upwardly from an upper surface of the floor in an area defined by the wall structure.

28. The crate of claim 23, wherein the pair of opposed end walls include two stepped surfaces that define a handle on each of the pair of opposed end walls.

29. The crate of claim 23, wherein the endwalls each include an upper portion and a lower portion, and a width of the upper portion is less than a width of the lower portion.

30. The crate of claim 23, wherein a width of the upper wall portion of each of the sidewalls is less than a width of the lower wall portion of each of the sidewalls, and the upper wall portion is uninterrupted by openings.

31. The crate of claim 23, wherein an entirety of an upper surface of the floor is flat.

32. The crate of claim 23, wherein an upper surface of the sidewalls defines a non-flat contour.

33. The crate of claim 23, wherein the corner sections wrap around to define part of the sidewalls and part of the endwalls.

34. The crate of claim 23, wherein an upper surface of a portion of the endwall above the handle is substantially flat.

35. A nestable display crate comprising:

a floor defining a substantially flat surface, wherein the floor is defined by a single flat area; and a wall structure including endwalls and sidewalls extending around a periphery of the floor, wherein the sidewalls include a lower wall portion and an upper wall portion, the lower wall portion is connected to the floor, and at least a portion of the upper wall portion has a double wall thickness including two spaced apart walls separated by a void, wherein the endwalls include a cutout and a separate handle opening located above the cutout, the handle opening and the cutout are separated by a section of material, and a bottom of the cutout is open and provides complete clearance under the cutout, wherein the endwalls include an endwall lower wall portion defining the cutout and an endwall upper wall portion including the handle opening, and the cutout and the handle opening are located in a common plane, and wherein the endwall lower wall portion of the endwalls includes a recessed portion recessed inwardly relatively to the common plane, an outermost surface of the endwall upper wall portions of the endwalls are separated by a first distance and an outermost surface of the recessed portion of the endwall lower wall portions of the endwalls are separated by a second distance, and the first distance is greater than the second distance.

36. A nestable display crate comprising:

a floor defining a substantially flat surface, wherein the floor is defined by a single flat area; and a wall structure including endwalls and sidewalls extending around a periphery of the floor, wherein the sidewalls include a lower wall portion and an upper wall portion, the lower wall portion is connected to the floor, and at least a portion of the upper wall portion has a double wall thickness including two spaced apart walls separated by a void, wherein the endwalls include a cutout and a separate handle opening located above the cutout, the handle opening and the cutout are separated by a section of material, and a bottom of the cutout is open and provides complete clearance under the cutout, wherein the endwalls include an endwall lower wall portion defining the cutout and an endwall upper wall portion including the handle opening, and the cutout and the handle opening are located in a common plane, and wherein an outermost surface of the upper wall portions of the sidewalls define a plane, the lower wall portions of the sidewalls includes a recessed portion recessed inwardly relatively to the common plane, an outermost surface of the upper wall portions of the sidewalls are separated by a first distance, an outermost surface of the lower wall portions of the sidewalls are separated by a second distance, and the first distance is greater than the second distance.

37. A crate for bottles comprising:

a floor member;

a pair of opposed end walls; and a pair of opposed sidewalls integrally formed with the floor member and the pair of opposed end walls, wherein each of the pair of sidewalls includes a side band member defined by an upper edge and lower edge, the lower edge is spaced above the floor member by a predetermined distance to define a sidewall nesting area therebelow, the upper edge and the lower edge are directed downwardly in a plane of its respective sidewall to form with an adjacent end band member a corner band portion therebetween, and each side band member is matingly received within the corresponding nesting area of an identical crate.

38. The crate of claim 37, wherein each sidewall includes a plurality of projection members extending upwardly from the upper edge of each side band member of the pair of sidewalls and received within corresponding openings formed in the lower edge when nested below a similar crate.

39. The crate of claim 37, wherein at least one of opposed sidewalls includes an opening for providing visibility into the crate.

40. The crate of claim 37, wherein at least a portion of the pair of opposed sidewalls have a double wall construction including two spaced apart walls separated by a void.

41. The crate of claim 37, wherein the pair of opposed end walls include a handle.

42. A nestable display crate comprising:

a floor defining a substantially flat surface, wherein the substantially flat surface is substantially rectangular; and a wall structure including endwalls and sidewalls extending around a periphery of the floor, wherein the sidewalls include a lower wall portion and an upper wall portion, the lower wall portion is connected to the floor, and at least a portion of the upper wall portion has a double wall thickness including two spaced apart walls separated by a void, wherein the endwalls include a cutout and a separate handle opening, and wherein the lower wall portion of the sidewalls includes an inner wall and an outer wall, and the outer wall includes a single cutout and the inner wall includes a plurality of cutouts.

43. A nestable display crate comprising:

a floor defining a substantially flat surface, wherein the floor is defined by a single flat area; and a wall structure including endwalls and sidewalls extending around a periphery of the floor, wherein the sidewalls include a lower wall portion and an upper wall portion, the lower wall portion is connected to the floor, and at least a portion of the upper wall portion has a double wall thickness including two spaced apart walls separated by a void, wherein the endwalls include a cutout and a separate handle opening located above the cutout, the handle opening and the cutout are separated by a section of material, and a bottom of the cutout is open and provides complete clearance under the cutout, and wherein the lower wall portion of the sidewalls includes an inner wall and an outer wall, and the outer wall includes a single cutout and the inner wall includes a plurality of cutouts.

44. A nestable display crate comprising:

a floor defining a substantially flat surface;

a wall structure including endwalls and sidewalls extending around a periphery of the floor, wherein there are no columns between the sidewalls, wherein the sidewalls include portions of different heights, wherein the sidewalls include a lower wall portion and an upper wall portion, the lower wall portion is connected to the floor, and at least a portion of the upper wall portion has a double wall thickness including two spaced apart walls separated by a void, and wherein the endwalls include a cutout and a handle opening, wherein the cutout is located between two corner sections, the two corner sections have a first height, the endwalls have a second height, and the first height is less than the second height.

* * * * *